US009778583B2

(12) United States Patent
Terauchi et al.

(10) Patent No.: US 9,778,583 B2
(45) Date of Patent: Oct. 3, 2017

(54) TONER AND IMAGING METHOD

(71) Applicant: CANON KABUSHIKI KAISHA, Tokyo (JP)

(72) Inventors: Kazuo Terauchi, Numazu (JP); Yojiro Hotta, Mishima (JP); Takeshi Naka, Suntou-gun (JP); Motohide Shiozawa, Mishima (JP); Shohei Tsuda, Suntou-gun (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/817,201

(22) Filed: Aug. 3, 2015

(65) Prior Publication Data

US 2016/0041482 A1 Feb. 11, 2016

(30) Foreign Application Priority Data

Aug. 7, 2014 (JP) ..... 2014-161482

(51) Int. Cl.

| | |
|---|---|
| ***G03G 9/125*** | (2006.01) |
| ***G03G 9/08*** | (2006.01) |
| ***G03G 9/09*** | (2006.01) |
| ***G03G 13/08*** | (2006.01) |
| ***G03G 9/097*** | (2006.01) |

(52) U.S. Cl.

CPC ..... *G03G 9/0827* (2013.01); *G03G 9/0819* (2013.01); *G03G 9/09* (2013.01); *G03G 9/09716* (2013.01); *G03G 13/08* (2013.01)

(58) Field of Classification Search

CPC ..... G03G 9/0783; G03G 9/09708; G03G 9/09716; G03G 9/097169; G03G 9/125; G03G 9/0815

See application file for complete search history.

(56) References Cited

U.S. PATENT DOCUMENTS

| | | | |
|---|---|---|---|
| 5,447,813 | A | 9/1995 | Hagiwara et al. |
| 5,968,701 | A | 10/1999 | Onuma et al. |
| 6,020,102 | A | 2/2000 | Fujimoto et al. |
| 6,077,638 | A | 6/2000 | Tanikawa et al. |
| 6,156,471 | A | 12/2000 | Kobori et al. |
| 6,187,496 | B1 | 2/2001 | Tanikawa et al. |
| 6,235,441 | B1 | 5/2001 | Tanikawa et al. |
| 6,586,147 | B2 | 7/2003 | Iida et al. |
| 6,586,151 | B1 | 7/2003 | Naka et al. |
| 6,653,036 | B1 | 11/2003 | Tanikawa et al. |

(Continued)

FOREIGN PATENT DOCUMENTS

| | | | |
|---|---|---|---|
| JP | 11-295931 | A | 10/1999 |
| JP | 2002-318467 | A | 10/2002 |

(Continued)

*Primary Examiner* — Hoa V Le

(74) *Attorney, Agent, or Firm* — Fitzpatrick Cella Harper and Scinto

(57) ABSTRACT

A toner having compatibility between transfer properties and cleaning properties is provided. A toner wherein a fine particle A containing a primary particle having a number average particle diameter (D1) of 80 nm or more and 400 nm or less is present on the surface of a toner particle at a coverage ratio of 5 to 40%, a fixing rate of 30 to 90% by mass, and a variation coefficient of 0.1 to 0.5 in a region of 0.5 $\pi\mu m^2$.

13 Claims, 8 Drawing Sheets

(56) References Cited

U.S. PATENT DOCUMENTS

| | | | | |
|---|---|---|---|---|
| 6,703,176 | B2 | 3/2004 | Naka et al. | |
| 7,138,213 | B2 | 11/2006 | Itakura et al. | |
| 7,270,923 | B2 * | 9/2007 | Matsumoto | G03G 9/0827 430/107.1 |
| 7,611,813 | B2 | 11/2009 | Ida et al. | |
| 8,877,414 | B2 | 11/2014 | Sugawara et al. | |
| 2005/0037693 | A1 * | 2/2005 | Uchikura | C09G 1/02 451/41 |
| 2005/0202332 | A1 * | 9/2005 | Ninomiya | G03G 9/0819 430/110.3 |
| 2011/0039200 | A1 * | 2/2011 | Kaya | G03G 9/0804 430/108.22 |
| 2012/0129088 | A1 * | 5/2012 | Kmiecik-Lawrynowicz | G03G 9/0819 430/108.3 |
| 2014/0295341 | A1 | 10/2014 | Fomitchev et al. | |
| 2015/0017583 | A1 | 1/2015 | Ota et al. | |

FOREIGN PATENT DOCUMENTS

| | | | |
|---|---|---|---|
| JP | 2007-4086 | A | 1/2007 |
| JP | 2007-58134 | A | 3/2007 |
| JP | 2007-108630 | A | 4/2007 |
| JP | 2012-68325 | A | 4/2012 |
| JP | 2013-92748 | A | 5/2013 |
| WO | 2013/063291 | A1 | 5/2013 |
| WO | 2013/146234 | A1 | 10/2013 |

* cited by examiner

TONER AND IMAGING METHOD

BACKGROUND OF THE INVENTION

Field of the Invention

The present invention relates to toners used in imaging methods of forming electrophotographic images or electrostatically charged images into apparent images, and imaging methods.

Description of the Related Art

Electrophotographic systems apply an electrostatic force or pressure to toner images developed on photosensitive members to transfer the toner images onto paper media. The toners used in such electrophotographic systems should have one important performance, i.e., transfer properties. Imperfect transfer of images result in image defects such as no or insufficient deposition of the toners. Accordingly, toners having high transfer properties are required to attain high quality images. Methods of preparing spherical toners to enhance transfer properties are proposed, and examples thereof include a method of preparing a toner having a circularity of 0.92 or more and less than 0.95 (Japanese Patent Application Laid-Open No. 2007-58134), and a method of preparing a toner having a circularity of 0.95 or more (Japanese Patent Application Laid-Open No. H11-295931).

Unfortunately, toners having high circularities readily roll on the surfaces of photosensitive members. Non-transferred toner T readily intrudes into the contact region N, as illustrated in FIG. 1, between a photosensitive member 310 and a cleaning blade 308, and readily escapes from the cleaning region through the contact region N.

In the conventional configurations, the contact pressure of the cleaning blade pressed against the photosensitive drum is increased to prevent such intrusion of the spherical toner into the cleaning nip, attaining favorable cleaning. However, higher contact pressure of the cleaning blade increases a load on a blade edge under environments at low temperature, high process speed, and high rotational speed of the photosensitive drum. Such an increase in the load on the blade edge may cause another problem after long-term use, such as partially chipped cleaning blades. For this reason, examination of spherical toners having high cleaning properties at low contact pressure of the cleaning blade is required.

Japanese Patent Application Laid-Open No. 2002-318467 proposes a method of form a layer of an external additive having a large particle diameter to block a toner particle. This disclose uses a toner including a combination of an external additive having a large particle diameter (such as sol gel silica) having a spherical shape and a sharp particle diameter distribution with an organic compound having a smaller particle diameter. It is confirmed that a toner having such a configuration has enhanced cleaning performance whereas it has been found that the toner escapes from the cleaning blade at a higher process speed.

Japanese Patent Application Laid-Open No. 2012-68325 proposes a method of preparing a toner having an adhesive force reduced by an external additive embedded into the surface of the toner to reduce an untransferred toner and enhance cleaning properties. It has been confirmed that the toner having such a configuration has enhanced cleaning performance whereas it has been found that the toner may escape from the cleaning blade during image formation under environments at low temperature and a higher process speed.

SUMMARY OF THE INVENTION

As described above, toners having large circularities have high transfer properties but readily causes imperfect cleaning. It is also found that imperfect cleaning is more readily caused probably by cleaning blades hardened under environments at low temperature.

The present invention is directed to providing a toner having compatibility between transfer properties and cleaning properties.

Further, the present invention is directed to providing an imaging method using the toner.

According to one aspect of the present invention, there is provided a toner including a toner particle containing a binder resin and a colorant, and a fine particle A, wherein the toner has an average circularity of 0.970 or more, the fine particle A contains a primary particle having a number average particle diameter (D1) of 80 nm or more and 400 nm or less, a coverage ratio of the surface of the toner particle covered with the fine particle A is 5% or more and 40% or less as determined by electron spectroscopy for chemical analysis (ESCA), the toner contains the fine particle A at a fixing rate of 30% by mass or more and 90% by mass or less, and a variation coefficient of the number of the fine particle A present in a region of 0.5 $\pi\mu m^2$ on the surface of the toner particle is 0.1 or more and 0.5 or less.

The present invention can provide a toner having a high circularity and an imaging method which can attain high transfer properties in apparatuses operated at high process speed under environments at low temperature, can attain high cleaning properties at a small load applied to a blade edge of a cleaning blade, and can reduce contamination of members by the external additive.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The toner according to the present invention attains advantageous effects for the following reasons.

Figure 1:
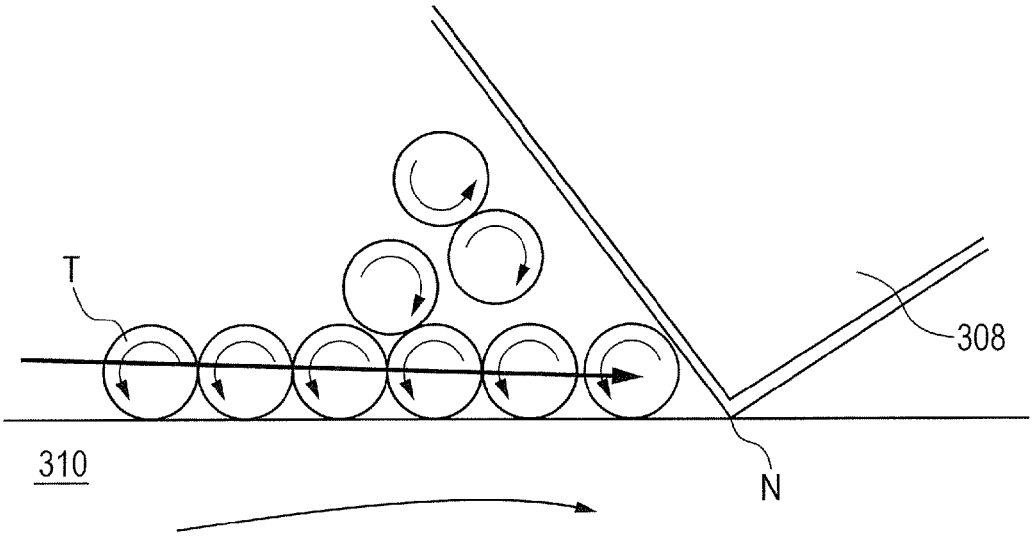
FIG. 1 is an enlarged view schematically illustrating a cleaning region on a photosensitive member.

It is believed that a toner having a high circularity readily rolls on the toner while rotating, and the rotating force of the toner is transmitted one another. The transmitted rotating force moves the toner T near the cleaning blade 308 faster as illustrated in FIG. 1. The increased moving speed of the toner T is readily converted into a force to push up the cleaning blade 308, so that the cleaning blade 308 is pushed up to form a gap between the cleaning blade 308 and the photosensitive member 310, through which the toner T readily passes. The toner T passed through the gap may cause image defects.

The present inventors have found that if in a toner having a high circularity, a fine particle containing a primary particle having a number average particle diameter (D1) of 80 nm or more and 400 nm or less (fine particle A) is present on the surface of a toner particle so as to satisfy the following three conditions, such a toner barely passes through the cleaning blade. The three conditions are:

(1) The coverage ratio of the surface of the toner particle covered with the fine particle A is 5% or more and 40% or less.

(2) The fixing rate of the fine particle A is 30% by mass or more and 90% by mass or less.

(3) The variation coefficient of the number of the fine particle A present on the surface of the toner particle is 0.1 or more and 0.5 or less.

If the three conditions are satisfied, the convex portions derived from the fine particle A are formed on the surface of the toner at substantially identical intervals. It seems that the convex portions derived from the fine particle A present on the toner particles are engaged with each other to prevent rolling of the toner. This effect is called "effect of preventing rolling of the toner."

In the related art, methods of adding an external additive having a relatively large particle diameter, such as the fine particle A, to a toner having a high circularity to enhance the fixing rate have been examined; however, imperfect cleaning has not been prevented in a durability test at a high process speed under an environment at low temperature and low humidity. The present inventors believe that it is because only by increasing the fixing rate of the fine particle A, the moving speed of the toner having a high circularity cannot be reduced near the cleaning blade in a high speed process.

Detailed description will now be given.

To attain the effect of preventing rolling of the toner, the convex portions derived from the fine particle A present on the toner particles should be engaged with each other. To attain such engagement with the convex portions, the particle diameter of the fine particle A forming the convex portion is an important factor.

Another important factor is the state of the fine particle A adhering to the surface of the toner. A significantly large or small number of the fine particles A on the surface of the toner cannot attain the engagement between the convex portions derived from the fine particle A. If the number of the convex portions derived from the fine particle A is significantly small, the surfaces of the toner particles having no convex portions are highly probably put in contact with each other, not attaining the engagement between the convex portions. Conversely if the number of the convex portions derived from the fine particle A is significantly large, the convex portions derived from the fine particle A occupy most of the surface of the toner, undesirably preventing engagement between the toner particles by the fine particle A. For this reason, to attain the engagement between the convex portions, the coverage ratio derived from the fine particle A is essentially 5% or more and 40% or less, preferably 5% or more and 30% or less.

In addition, the fine particle A forming the convex portion should be homogeneously present on the surface of the toner. If the fine particle A is unevenly present on the surface of the toner even at the same coverage ratio, opportunities for engagement between the toner particles are reduced. For this reason, to attain the engagement between the convex portions, a variation coefficient of the number of the fine particle A in a region of 0.5 $\pi\mu m^2$ on the surface of the toner should be 0.1 or more and 0.5 or less. The variation coefficient is preferably 0.1 or more and 0.4 or less.

Furthermore, the state of the fine particle A forming the convex portion fixed to the surface of the toner should be controlled. If the fine particle A is not fixed to the surface of the toner, the fine particle A readily moves on the surface of one toner particle or readily falls therefrom to move onto another toner particle to reduce the engagement between the convex portions in the toner. For this reason, the fixing rate of the fine particle A on the surface of the toner is 30% by mass or more and 90% by mass or less.

As described above, if the state of the fine particle A present on the surface of a toner is controlled, the toner attains the effect of preventing rolling of the toner. Even at a higher process speed (e.g., 300 mm/sec), such a toner can form a region immediately before the cleaning blade, where the toner moves slowly or stagnates. As a result, the number of the toners intruding into the blade is significantly reduced to prevent the blade from being pushed up by the toner, so that the toner barely passes through the blade.

To attain high transfer properties, the toner particle should have an average circularity of 0.970 or more. The average circularity is preferably 0.975 or more, more preferably 0.980 or more.

To attain high transfer properties, the toner according to the present invention has a weight average particle diameter (D4) of preferably 5.0 μm or more and 10.0 μm or less, more preferably 6.0 μm or more and 9.0 μm or less.

To attain the effect of preventing rolling of the toner according to the present invention, the number average particle diameter (D1) of the primary particle of the fine particle A should be 80 nm or more and 400 nm or less.

A fine particle A having a number average particle diameter (D1) within this range readily form, on the surface of the toner, a convex portion to be readily engaged. If the number average particle diameter of the fine particle A is less than 80 nm, the convex portion to be formed on the surface of the toner has an insufficient height, leading to difficulties in attaining the effect of preventing rolling of the toner by engagement between the convex portions. If the number average particle diameter of the fine particle A is more than 400 nm, the fine particle A is readily removed from the surface of the toner.

The number average particle diameter (D1) of the primary particle of the fine particle A is more preferably within the range of 90 nm or more and 200 nm or less.

Examples of the fine particle A include particles of silica, alumina, titanium oxide, barium titanate, magnesium titanate, calcium titanate, strontium titanate, zinc oxide, quartz sand, clay, mica, wollastonite, diatomite, cerium chloride, red iron oxide, chromium oxide, cerium oxide, antimony trioxide, magnesium oxide, zirconium oxide, silicon carbide, and silicon nitride. Among these particles, preferred are particles of inorganic oxides such as silica particles and titanium oxide particles. The fine particle A can be subjected to a surface treatment, such as hydrophobization, to stabilize charging properties and developability.

The surface modification can be performed by any known method. Specifically, examples thereof include each coupling treatments with silane, titanate, or aluminate. Any coupling agent can be used in the coupling treatments. Suitable examples thereof include silane coupling agents such as methyltrimethoxysilane, phenyltrimethoxysilane, methylphenyldimethoxysilane, diphenyldimethoxysilane, vinyltrimethoxysilane, γ-aminopropyltrimethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilane, and hexamethyldisilazane; titanate coupling agents; and aluminate coupling agents.

An organic-inorganic composite fine particle can also be used as the fine particle A according to the present invention.

The organic-inorganic composite fine particle refers to a particle including a base particle made of an organic component such as a vinyl resin particle and an inorganic fine particle (inorganic fine particle B) is embedded to the base particle. The in organic fine particle (The inorganic fine particle B) is in the state of being exposed.

The organic-inorganic composite fine particle can have a convex portion derived from the inorganic fine particle B on the surface of the organic-inorganic composite fine particle. The organic-inorganic composite fine particle is in the form of a silica-polymer particle reported in The 109th Annual Conference of the Imaging Society of Japan, for example. This silica-polymer particle is also disclosed in WO 2013/063291 and Japanese Patent Application Laid-Open No. 2013-92748.

The organic-inorganic composite fine particle can have a shape factor SF-1 of 100 or more and 150 or less measured at a magnification of 200000 times. The shape factor SF-1 is an index indicating the degree of the roundness of the particle. A shape factor of 100 indicates a perfect circle. A larger shape factor indicates that the shape of the particle is more significantly deviated from the circularity and closer to amorphousness. The shape factor SF-1 is more preferably 100 or more and 120 or less.

The organic-inorganic composite fine particle can have a shape factor SF-2 of 100 or more and 150 or less measured at a magnification of 200000 times. The shape factor SF-2 is an index indicating the degree of surface irregularity of a particle. A shape factor SF-2 of 100 indicates a perfect circle. A larger shape factor indicates that the particle has a higher degree of surface irregularity. The shape factor SF-2 is more preferably 110 or more and 150 or less.

Shape factors SF-1 and SF-2 within these ranges seem to attain anchoring of the organic-inorganic composite fine particle to the surface of the toner due to the effect caused by the surface irregularity of the particle (i.e., convex portions). This anchoring prevents the organic-inorganic composite fine particle from moving on or falling from the surface of the toner after long-term use of the toner through repeated collision of the toner by stirring. If the organic-inorganic composite fine particle is used as the fine particle A, convex portions derived from the organic-inorganic composite fine particle can be readily fixed to the surface of the toner to attain the effect of preventing rolling of the toner. The organic-inorganic composite fine particle also attains high cleaning performance due to the effect of preventing rolling of the toner.

More preferably, the organic-inorganic composite fine particle can have a coverage ratio of the surface of the base particle (e.g., vinyl resin particle) covered with the inorganic fine particle B of 20% or more and 70% or less, which is measured by ESCA. The coverage ratio is more preferably 30% or more and 70% or less.

The organic-inorganic composite fine particle can be prepared by the method described in WO 2013/063291. Further examples of the method include a method of embedding the inorganic fine particle B into a base particle formed of an organic component such as a resin afterward to prepare an organic-inorganic composite fine particle, and a method of dispersing the inorganic fine particle B and a dissolved resin in a solution to prepare an organic-inorganic composite fine particle.

In embedding of the inorganic fine particle B into a base particle formed of an organic component such as a resin afterward to prepare an organic-inorganic composite fine particle, an organic resin fine particle is first prepared, for example. Examples of the method of preparing an organic resin fine particle include a method of pulverizing a freeze-dried resin into fine particles; a method of emulsifying and suspending a resin dissolved in a solution to prepare an organic resin fine particle; and a method of polymerizing a monomer of a resin component by emulsion polymerization or suspension polymerization to prepare an organic resin fine particle.

The inorganic fine particle B can be embedded into the organic resin fine particle with a hybridizer (made by Nara Machinery Co., Ltd.), a Nobilta powder processing machine (made by Hosokawa Micron Corporation), a Mechanofusion (made by Hosokawa Micron Corporation), a High Flex Gral system (made by EARTHTECHNICA CO., LTD.), or the like. The organic resin fine particle and the inorganic fine particle B can be treated with these apparatuses to uniformly fix the inorganic fine particle B to the surface of the organic resin fine particle. Thereby an organic-inorganic composite fine particle can be prepared.

Examples of the organic component for the organic-inorganic composite fine particle include homopolymers of styrenes such as polystyrene and poly(vinyltoluene) and substituted products thereof; styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleic acid ester copolymers; poly (methyl methacrylate), poly(butyl methacrylate), poly(vinyl acetate), polyethylene, polypropylene, poly(vinylbutyral), silicone resins, polyester resins, polyamide resins, epoxy resins, polyacrylic acid resins, polyolefin resins such as polyethylene and polypropylene, polyacrylonitrile, poly(vinyl acetate), poly(vinylbutyral), poly(vinyl chloride), poly (vinylcarbazole), poly(vinyl ether) and poly(vinyl ketone), vinyl chloride-vinyl acetate copolymers, straight silicone resins having organosiloxane bonds or modified products thereof, fluorine resins such as poly(tetrafluoroethylene), poly(vinyl fluoride), poly(vinylidene fluoride), and poly (chlorotrifluoroethylene), phenol resins, amino resins such as urea-formaldehyde resins, benzoguanamine resins, urea resins, and polyamide resins, and epoxy resins. These can be used alone or in combination.

Examples of a polymerizable monomer of the organic component include styrene monomers such as styrene, o-methylstyrene, m-methylstyrene, p-methylstyrene, p-methoxystyrene, and p-ethylstyrene; acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers such as acrylonitriles, methacrylonitriles, and acrylamides. These monomers can be used alone or in the form of a mixture thereof.

The surface of the organic-inorganic composite fine particle can be treated with an organic silicon compound or silicone oil. The surface treatment may be performed on an organic-inorganic composite fine particle, or may be performed on an inorganic fine particle B, and then the surface treated inorganic fine particle B and a resin may be formed into a composite particle.

The organic-inorganic composite fine particle or the inorganic fine particle B used in the organic-inorganic composite fine particle can be chemically hydrophobized with an organic silicon compound physically adsorbed thereon. As a preferred method of hydrophobization, a silica fine particle is generated through vapor-phase oxidation of a silicon halogen compound, and is treated with an organic silicon compound. Examples of such an organic silicon compound include the following: hexamethyldisilazane, methyltrimethoxysilane, octyltrimethoxysilane, isobutyltrimethoxysilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxanes having 2 to 12 siloxane units per molecule and having Si atoms in terminal units, each of Si atoms in the terminal units bonds to a hydroxyl group. These can be used alone or in the form of a mixture.

The organic-inorganic composite fine particle or the inorganic fine particle B used in the organic-inorganic composite fine particle may be subjected to a treatment with silicone oil, or may be subjected to a treatment with silicone oil in combination with the hydrophobization described above.

The silicone oil having a kinematic viscosity at 25° C. of 30 $mm^2/s$ or more and 1000 $mm^2/s$ or less can be used as a preferred silicone oil. Examples thereof include dimethyl silicone oil, methylphenyl silicone oil, α-methylstyrene modified silicone oil, chlorophenyl silicone oil, and fluorine modified silicone oil.

Examples of a method of treating a particle with silicone oil include: a method of directly mixing an inorganic fine particle, which is treated with a silane coupling agent, with silicone oil in a mixer such as a Henschel mixer; and a method of spraying silicone oil onto an inorganic fine particle as a base. More preferred is a method of dissolving and dispersing silicone oil in an appropriate solvent, adding and mixing an inorganic fine particle with the solvent, and removing the solvent.

Examples of the inorganic fine particle B used in the organic-inorganic composite fine particle include particles of silica, alumina, titania, zinc oxide, strontium titanate, oxidation cerium, and calcium carbonate. In particular a silica particle used as the inorganic fine particle B has high charging properties, and can attain high developability. The silica may be dry silica prepared by a dry process, such as fumed silica, or may be wet silica prepared by a wet process, such as sol gel silica.

The state of the fine particle A present on the surface of the toner as specified in the present invention can be attained, for example, by control of treatment conditions with the following treating apparatus: a Henschel mixer (made by NIPPON COKE & ENGINEERING CO., LTD.), a SUPERMIXER (made by KAWATAMFG Co., Ltd.), a Nobilta (made by Hosokawa Micron Corporation), and a hybridizer (made by Nara Machinery Co., Ltd.).

Usable is the following toner treating apparatus including: a treatment chamber accommodating objects including a toner particle and a fine particle A, and a rotator disposed in the treatment chamber to be rotatable about a driving axis, wherein the rotator includes a rotary body, and a treating unit having a treatment surface treating the objects through collision between the treatment surface and the objects caused by rotation of the rotator, the treatment surface extending from the outer peripheral surface of the rotary body toward the outside in the diameter direction, the outer region of the treatment surface is arranged at downstream position in the rotational direction with respect to the inner region of the treatment surface.

Namely, the treatment surface disposed in the rotary body externally extends from the outer peripheral surface of the rotary body in the diameter direction, and the outer region of the treatment surface is inclined in the rotational direction with respect to the inner region of the treatment surface (the treatment surface is inclined so as to face to the center of the rotary body).

The toner treating apparatus (surface modification apparatus) will now be described in detail with reference to FIGS. 3 to 7C. It should be noted that the dimensions, materials, shapes, and relative arrangements of components described in this embodiment can be appropriately modified.

[Toner Treating Apparatus]

Figure 3:
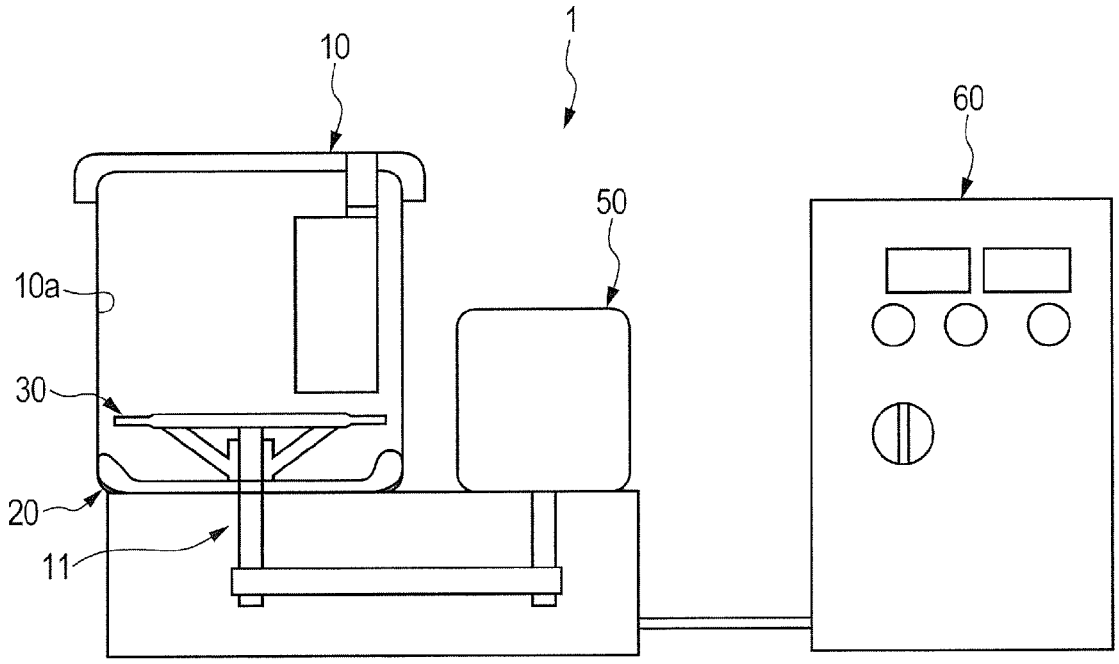
FIG. 3 is a schematic view illustrating an exemplary toner treating apparatus.

FIG. 3 is a schematic view illustrating a toner treating apparatus applicable to the present invention.

A toner treating apparatus 1 includes a treatment chamber (treatment tank) 10, a stirring blade 20 as a stir-up unit, a rotator 30, a driving motor 50, and a control unit 60. In this embodiment, the treatment chamber 10 accommodates the objects including a toner particle and an external additive. The stirring blade 20 is rotatably disposed under the rotator 30 on the bottom of the treatment chamber 10. The rotator 30 is rotatable disposed above the stirring blade 20.

[Treatment Chamber]

Figure 4:
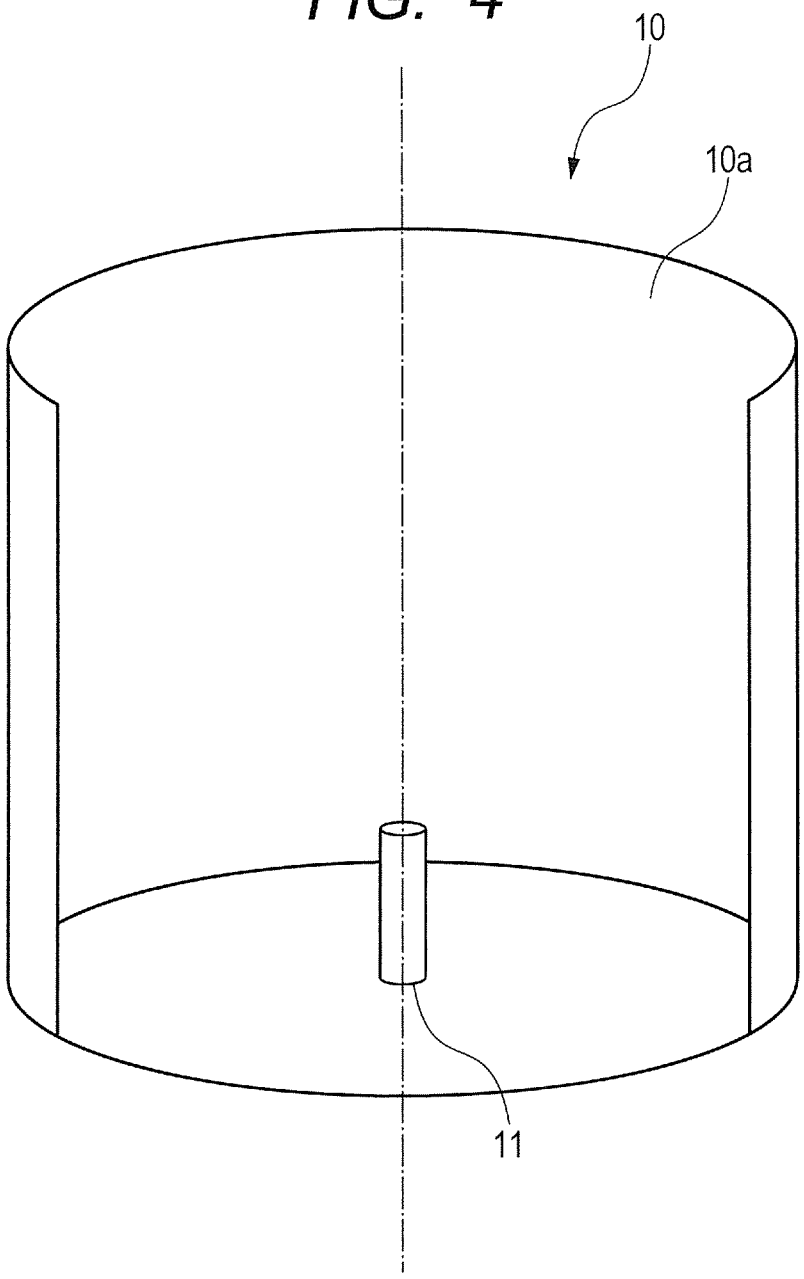
FIG. 4 is a schematic perspective view illustrating a configuration of a treatment chamber of an exemplary toner treating apparatus.

FIG. 4 is a schematic view illustrating the treatment chamber 10. For convenience of description, FIG. 4 illustrates the treatment chamber 10 whose inner circumferential surface (inner wall) 10*a* is partially cut away.

In the present embodiment, the treatment chamber 10 is in the form of a cylindrical container having a substantially flat bottom. The treatment chamber 10 includes a driving axis 11 substantially in the center of the bottom, and the stirring blade 20 and the rotator 30 are attached to the driving axis 11.

From the viewpoint of strength, the treatment chamber 10 can be formed of a metal such as iron or SUS, and can have an inner surface formed of a conductive material or an inner surface processed to be electrically conductive.

[Stir-Up Unit]

Figure 5A:
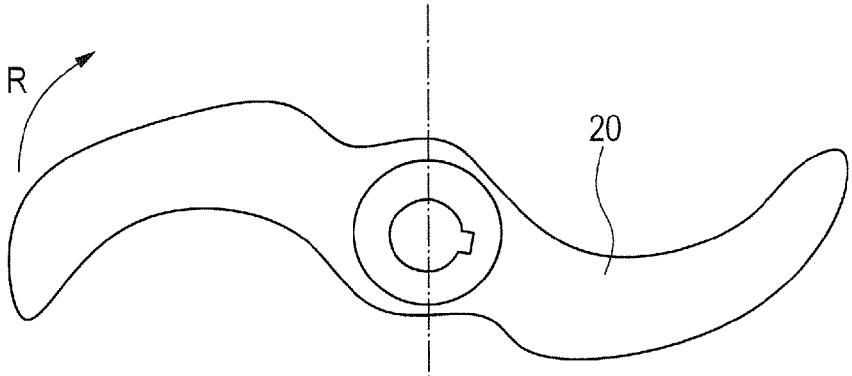
FIG. 5A is a schematic top view illustrating a configuration of a stirring blade of an exemplary toner treating apparatus.
Figure 5B:
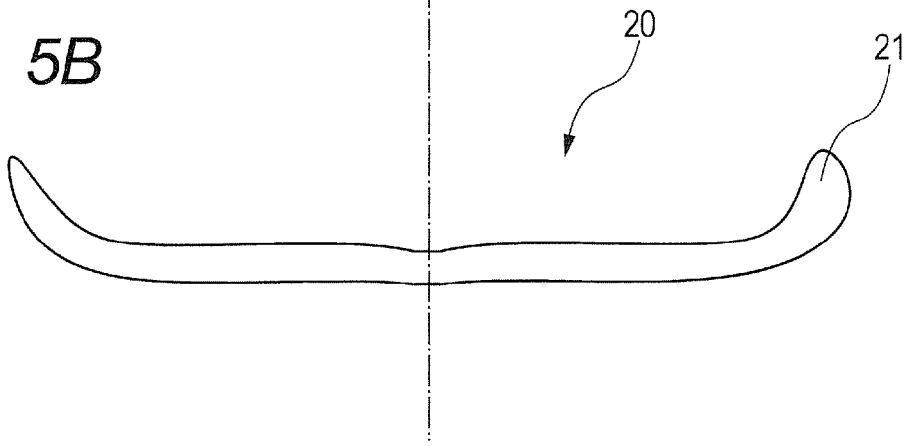
FIG. 5B is a schematic side view illustrating a configuration of a stirring blade of an exemplary toner treating apparatus.

FIGS. 5A and 5B are schematic views illustrating a stirring blade 20 as a stir-up unit. FIG. 5A is a top view, and FIG. 5B is a side view thereof.

In the present embodiment, the stirring blade 20 can rotate to stir up the objects including a toner particle and an external additive inside the treatment chamber 10.

The stirring blade 20 has a blade portion 21 extending from the center of rotation toward the outside (toward the outside in the diameter direction (outer diameter direction), outer diameter side). The blade portion 21 has a curled tip to stir up the objects.

The shape of the blade portion 21 can be appropriately designed according to the dimension and the operating conditions of the toner treating apparatus 1, the amount of the objects to be placed, and specific gravity.

From the viewpoint of strength, the stirring blade 20 can be formed of a metal such as iron and SUS. The stirring blade 20 may be plated or coated when necessary to give wear resistance.

The stirring blade 20 is fixed to the driving axis 11 disposed on the bottom of the treatment chamber 10 to rotate clockwise seen from above (in the state illustrated in FIG. 5A). In the drawing, the arrow R indicates the rotational direction of the driving axis 11.

The rotation of the stirring blade 20 stirs up the objects in the treatment chamber 10 while rotating in the same direction as that of the stirring blade 20. The objects then fall due to gravity. The objects are homogeneously mixed in this manner.

[Rotator]

Figure 6A:
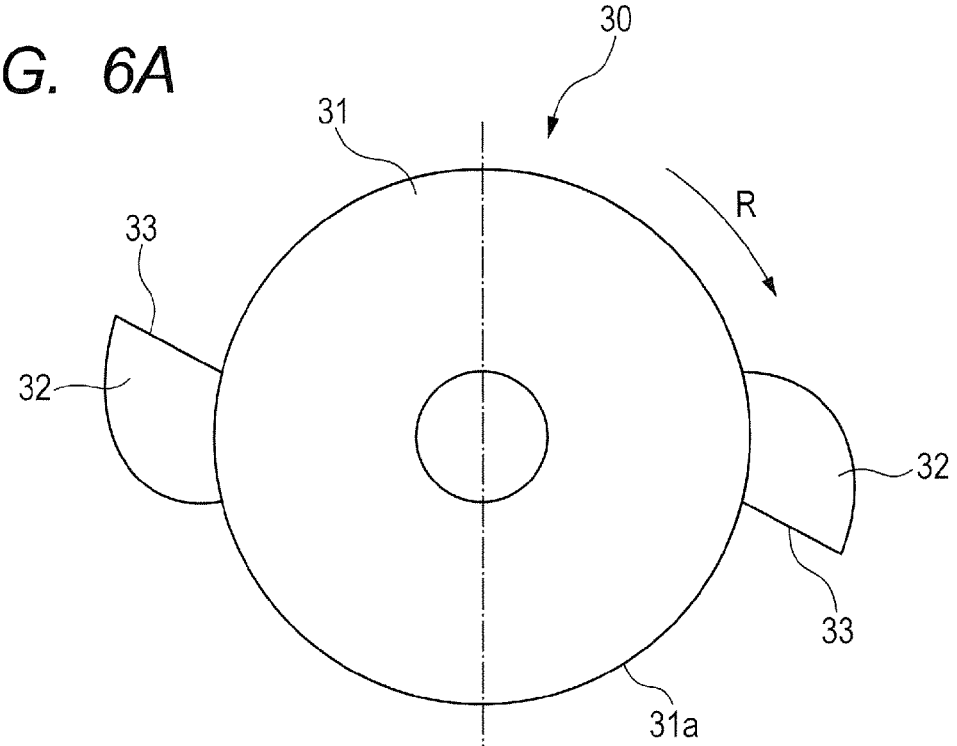
FIG. 6A is a schematic top view illustrating a configuration of a rotator of an exemplary toner treating apparatus.
Figure 6B:
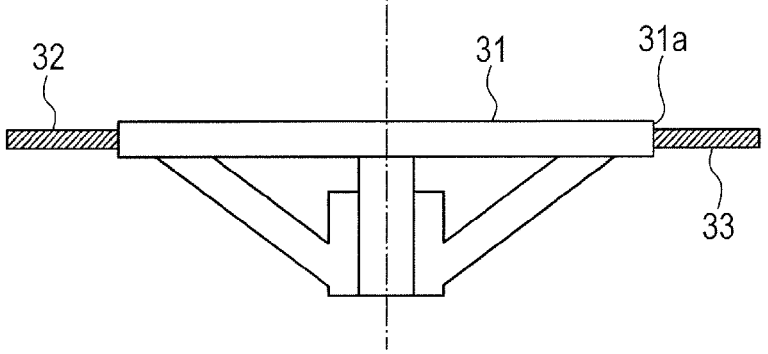
FIG. 6B is a schematic cross-sectional view illustrating a configuration of a rotator of an exemplary toner treating apparatus.
Figure 7A:
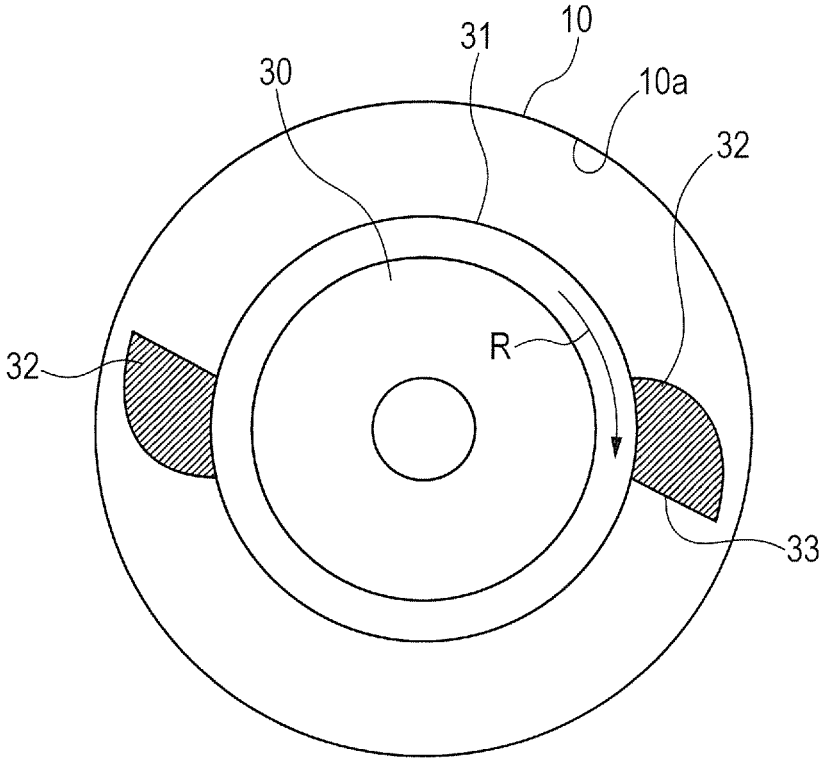
FIG. 7A is a diagram for illustrating details (top view) of a configuration of a rotator in an exemplary toner treating apparatus.
Figure 7B:
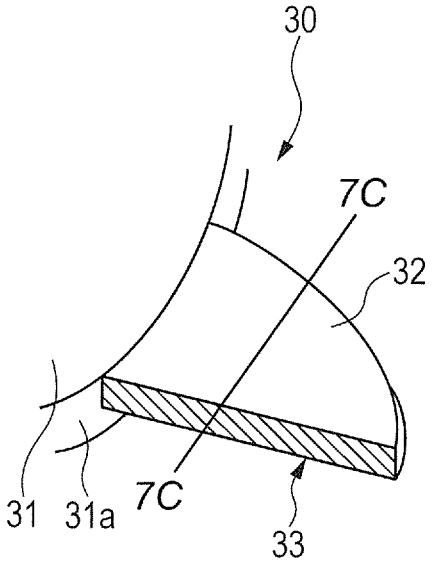
FIG. 7B is a diagram for illustrating details (partially perspective view) of a configuration of a rotator in an exemplary toner treating apparatus.
Figure 7C:
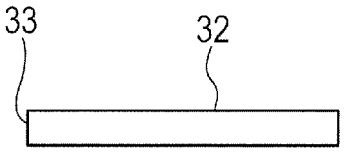
FIG. 7C is a diagram for illustrating details (taken along 7C-7C in the cross-sectional view in FIG. 7B) of a configuration of a rotator in an exemplary toner treating apparatus.

FIGS. 6A to 6B and FIGS. 7A to 7C are schematic views illustrating the rotator 30. FIG. 6A is a top view of the rotator 30, and FIG. 6B is a side view thereof. FIG. 7A is a top view illustrating the rotator 30 installed in the treatment chamber 10, FIG. 7B is a perspective view illustrating an essential portion of the rotator 30, and FIG. 7C is a diagram illustrating the cross section taken along 7C-7C in FIG. 7B.

In the present embodiment, the rotator 30 is disposed above the stirring blade 20 in the treatment chamber 10, and is fixed to the same driving axis 11 as the stirring blade 20 to rotate in the same direction as that of the stirring blade 20 (direction indicated by the arrow R).

The rotator 30 includes a rotary body 31, and a treating unit 32 having a treatment surface 33 treating the objects through collision between the treatment surface and the objects caused by rotation of the rotator 30. The treatment surface 33 extends from the outer peripheral surface 31*a* of the rotary body 31 toward the outer diameter direction. The outer region of the treatment surface 33 is arranged at downstream position in the rotational direction with respect to the inner region of the treatment surface 33.

Namely, in FIG. 7A, the treatment surface 33 is disposed oblique to the radius direction of the rotator 30 in the rotational direction R of the rotator 30. In other words, in FIGS. 7A to 7B, the treatment surface 33 is disposed oblique to the radius direction of the rotator 30 in a direction facing the center of rotation of the rotator 30.

The rotation of the rotator 30 causes collision between the objects and the treatment surface 33 to crush aggregates of the external additive.

During this treatment, a significantly large area of the treatment surface 33 may affect stir-up of the objects to increase the drive torque or the temperature of the objects whereas a significantly small area thereof may not attain desired treatment ability.

Accordingly, the area of the treatment surface 33 is appropriately designed (set) according to the dimension and the operation conditions of the toner treating apparatus, the amount of the objects to be placed, and specific gravity.

The flow rate in a cooler (not illustrated) attached to the toner treating apparatus 1 can be adjusted to control the temperature of the toner. Thereby, the fixing rate of the fine particle A can be enhanced.

The toner according to the present invention can contain an inorganic fine particle as a second external additive. The inorganic fine particle contained in the toner can give charging properties and fluidity. Examples of such an inorganic fine particle include fine particle silicas such as wet silica and dry silica, treated silicas prepared by surface treating these silicas with silane coupling agents, titanium coupling agents, or silicone oil, or titanium oxide.

To give charging properties and fluidity, dry silica prepared through vapor-phase oxidation of a silicon halogen compound or fumed silica can be used. The dry process uses a thermal decomposition oxidation reaction of silicon tetrachloride gas in oxygen and hydrogen represented by the following reaction formula.

$$SiCl_4+2H_2+O_2 \rightarrow SiO_2+4HCl$$

The inorganic fine particle can be a composite fine powder of another metal oxide and silica prepared through this dry process of another metal halogen compound such as aluminum chloride or titanium chloride and a silicon halogen compound.

Furthermore, processed silica fine powder prepared by hydrophobizing silica fine powder generated through gaseous phase oxidation of the silicon halogen compound can be used. In particular, the processed silica fine powder having a degree of hydrophobizing of 30 or more and 98 or less determined by titration in a methanol titration test can be used.

The silica fine powder can be hydrophobized by chemical treatment of the silica fine powder with an organic silicon compound reactive therewith or physically adsorbed thereon. Usable is a treatment of silica fine powder generated through vapor-phase oxidation of a silicon halogen compound with an organic silicon compound. Examples of such an organic silicon compound include the following: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxane having 2 to 12 siloxane units per molecule and having Si atoms in terminal units, each of Si atoms in the terminal units bonds to a hydroxyl group. These can be used alone or in the form of a mixture.

The silica fine powder may be treated with silicone oil to enhance the slip properties on the photosensitive member. The silica fine powder may be subjected to this treatment with silicone oil in combination with the hydrophobization described above.

Silicone oil having a kinematic viscosity at 25° C. of 30 $mm^2/s$ or more and 1000 $mm^2/s$ or less can be used. For example, dimethyl silicone oil, methylphenyl silicone oil, α-methylstyrene modified silicone oil, chlorophenyl silicone oil, and fluorine modified silicone oil can be used in particular.

Examples of the method of treating silicone include the following: a method of directly mixing a silica fine powder treated with a silane coupling agent with silicone oil in a mixer such as a Henschel mixer; a method of spraying silicone oil onto a silica fine powder as a base; or a method of dissolving and dispersing silicone oil in an appropriate solvent, adding and mixing a silica fine powder, and removing the solvent. After the treatment with silicone oil, the silicone oil treated silica is more preferably heated in an inert gas at a temperature of 200° C. or more (more preferably 250° C. or more) to stabilize the coating on the surface.

Suitable examples of the silane coupling agent include hexamethyldisilazane (HMDS).

In the present invention, silica preliminarily treated with a coupling agent can be treated with silicone oil, or silica can be treated with a coupling agent and silicone oil at the same time.

The inorganic fine particle can be used in an amount of 0.01 parts by mass or more and 3.00 parts by mass or less, preferably 0.05 parts by mass or more and 2.00 parts by mass or less relative to 100.00 parts by mass of the toner particle.

Examples of sieving apparatuses used to sieve a coarse particle after external addition include the following: an Ultrasonic sieving apparatus (made by Koei Sangyo Co., Ltd.); a Resonasieve and a Gyronshifter (made by TOKUJU CORPORATION); a Vibrasonic system (made by DALTON CORPORATION); a Soniclean sieving apparatus (made by SINTOKOGIO, LTD.); a Turbo Screener (made by FREUND-TURBO CORPORATION (the former Turbo Kogyo Co., Ltd.); and a Microshifter (made by Makino mfg Co., Ltd.).

The toner according to the present invention includes the fine particle A and the toner particle described above. The toner particle contains a binder resin and a colorant.

Any known and typical binder resin can be used. The colorant will be described later. Besides the binder resin and the colorant, the toner particle may further contain known and typical additives such as wax, magnetic substances, and charge control agents.

The toner particle can be prepared by any method. Examples of methods of preparing a toner particle having high circularity include methods of directly preparing a toner particle in a hydrophilic medium, such as suspension polymerization, interface polymerization, and dispersion polymerization (hereinafter also referred to as polymerization); methods by emulsification association, emulsification polymerization, and suspension granulation; and methods of pulverizing a toner thermally formed into a spherical shape. Among these methods, suspension polymerization can be used.

In suspension polymerization, a toner particle is prepared at least through the following two steps, i.e., a granulation step of dispersing a polymerizable monomer composition including at least a polymerizable monomer, a colorant, and wax in an aqueous medium to prepare liquid droplets of the polymerizable monomer composition, and a polymerization step of polymerizing the polymerizable monomer in the liquid droplets into a binder resin. In the preparation of the toner according to the present invention, a low molecular weight resin can be contained in the polymerizable monomer composition.

The toner can include a toner particle having at least a core and a shell. In the toner particle, the core is covered with the shell. Such a structure of the toner particle can prevent charging failure or blocking caused by bleeding of the core onto the surface of the toner particle. More preferred is a toner particle having a surface layer on the surface of the shell, the surface layer having a different resin composition from that of the shell. The surface layer can enhance the environmental stability, the durability, and the blocking resistance of the toner.

Vinyl polymerizable monomers can be used in preparation of the toner particle. Examples thereof include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethylacrylate, diethylphosphate ethylacrylate, dibutylphosphate ethylacrylate, and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethylmethacrylate, and dibutylphosphate ethylmethacrylate; methylene aliphatic monocarboxylic acid esters vinyl esters such as vinyl acetate, vinyl propionate, vinyl butyrate, vinyl benzoate, and formic acid vinyl; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

The shell is formed of a vinyl polymer made of these vinyl polymerizable monomers or a vinyl polymer polymerized in advance. Among these vinyl polymers, styrene polymers, styrene-acrylic copolymers, or styrene-methacrylic copolymers can be used to efficiently cover the wax mainly forming the inner portion or the central portion of the toner particle.

Examples of the wax include petroleum waxes such as paraffin wax, microcrystalline wax, and petrolatum and derivatives thereof; montan wax and derivatives thereof; hydrocarbon waxes prepared by a Fischer-Tropsch method and derivatives thereof; polyolefin waxes such as polyethylene and polypropylene and derivatives thereof; and natural waxes such as carnauba wax and candelilla wax and derivatives thereof. The derivatives include oxides, block copolymers with vinyl monomers, and grafted products. In addition, the following can also be used: fatty acids such as higher aliphatic alcohols, stearic acid, and palmitic acid or compounds thereof; acid amide waxes, ester waxes, ketones, hard castor oil and derivatives thereof, plant-derived waxes, animal-derived waxes, and silicone resins.

Any known and typical colorant, such as black colorants, yellow colorants, magenta colorants, and cyan colorants, can be used.

Black colorants usable are carbon black, magnetic substances, and mixtures of yellow, magenta, and cyan colorants into black. In particular dyes and carbon black should be carefully used because many of these inhibit polymerization.

Examples of the yellow colorants include compounds such as condensation azo compounds, isoindolinone compounds, anthraquinone compounds, azo metal complexes, methine compounds, and allylamide compounds. Specifically, examples thereof include C.I. Pigment Yellows 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Examples of the magenta colorants include condensation azo compounds, diketopyrrolopyrrole compounds, anthraquinone compounds, quinacridone compounds, basic dye lake compounds, naphthol compounds, benzimidazolone compounds, thioindigo compounds, and perylene compounds. Specifically, examples thereof include C.I. Pigment Reds 2, 3, 5, 6, 7, 23, 48:2, 48:3, 48:4, 57:1, 81:1, 122, 146, 166, 169, 177, 184, 185, 202, 206, 220, 221, 238, 254, and 269; and C.I. Pigment Violet 19.

Examples of the cyan colorants include copper phthalocyanine compounds and derivatives thereof, anthraquinone compounds, and basic dye lake compounds. Specifically, examples thereof include C.I. Pigment Blues 1, 7, 15, 15:1, 15:2, 15:3, 15:4, 60, 62, and 66.

These colorants can be used alone, in the form of a mixture, or further in the form of a solid solution. The colorant can be selected in view of the hue angle, chroma, lightness, lightfastness, OHP transparency, and dispersibility in the toner. The amount of the colorant to be added is 1 to 20 parts by mass relative to 100 parts by mass of the polymerizable monomer or the binder resin.

The toner according to the present invention may be a magnetic toner containing a magnetic material as the colorant. Examples of the magnetic material include iron oxides such as magnetite, hematite, and ferrite; metals such as iron, cobalt, and nickel; and alloys of these metals and metals such as aluminum, cobalt, copper, lead, magnesium, tin, zinc, antimony, beryllium, bismuth, cadmium, calcium, manganese, selenium, titanium, tungsten, and vanadium and mixtures thereof. The magnetic substances can have surfaces modified. In preparation of a magnetic toner by polymerization, magnetic substances hydrophobized with a surface modifier not inhibiting polymerization can be used. Examples of such a surface modifier include silane coupling agents and titanium coupling agents. These magnetic substances have a number average particle diameter (D1) of preferably 2 μm or less, more preferably 0.1 μm or more and 0.5 μm or less. The amount of the magnetic substance contained in the toner particle is 20 parts by mass or more and 200 parts by mass or less relative to 100 parts by mass of the polymerizable monomer or the binder resin, particularly preferably 40 parts by mass or more and 150 parts by mass or less relative to 100 parts by mass of the binder resin.

The toner particle can also be prepared by pulverization. In this case, in the step of mixing raw materials, predetermined amounts of materials for a toner particle, such as a polyester resin (binder resin), a colorant, and other additives, are weighed, are compounded, and are mixed. Examples of mixing apparatuses include double cone mixers, V type mixers, drum mixers, SUPERMIXERs, Henschel mixers, Nauta Mixers, and Mechanohybrid mixers (made by NIPPON COKE & ENGINEERING CO., LTD.).

Next, the mixed materials are melt kneaded, and a colorant and the like are dispersed in the polyester resin. The melt kneading step can be performed with a batch type kneader such as a pressure kneader and a Banbary mixer or a continuous kneader. Typically used is a mono- or biaxial extruder having an advantage in continuous production. Examples thereof include KTK biaxial extruders (made by Kobe Steel, Ltd.), TEM biaxial extruders (made by TOSHIBA MACHINE CO., LTD.), PCM kneaders (made by Ikegai Corp.), biaxial extruders (made by KCK Engineering Co., Ltd.), co-kneaders (made by Buss AG), and Kneadex (made by NIPPON COKE & ENGINEERING CO., LTD.). The resin composition prepared through the kneading further can be spontaneously cooled, or can be rolled with a two-roll or the like to be forcibly cooled with water in a cooling step.

The cooled resin composition is then pulverized into a desired particle diameter in the pulverization step. In the pulverization step, the kneaded product is ground with a mill such as a crusher, a hammer mill, or a feather mill, and is then pulverized with a CRYPTRON system (made by EARTHTECHNICA CO., LTD.), a super rotor (made by NISSHIN ENGINEERING INC.), a turbo mill (made by FREUND-TURBO CORPORATION), or an air jet pulverizer.

Subsequently, the pulverized particles are classified with a classifier or a sieving apparatus such as an inertial classifier Elbow Jet (made by Nittetsu Mining Co., Ltd.), a centrifugal classifier Turboplex (made by Hosokawa Micron Corporation), a TSP separator (made by Hosokawa Micron Corporation), Faculty (made by Hosokawa Micron Corporation) when necessary to prepare a toner particle.

The toner particle, after pulverization, is formed into a spherical form with a hybridization system (made by Nara Machinery Co., Ltd.), a Mechanofusion system (made by Hosokawa Micron Corporation), Faculty (made by Hosokawa Micron Corporation), or a Meteorainbow MR Type (made by Nippon Pneumatic Mfg. Co., Ltd.).

The toner according to the present invention can be used as a one-component developer, and can also be used as a two-component developer in the form of a mixture with a magnetic carrier.

Generally known examples of the magnetic carrier usable include magnetic substances such as iron powder having an oxidized surface or unoxidized iron powder; metal particles of iron, lithium, calcium, magnesium, nickel, copper, zinc, cobalt, manganese, and rare earth elements, and alloy particles and oxide particles thereof; and ferrite; and magnetic dispersion resin carriers (the so-called resin carriers) containing these magnetic substances and binder resins carrying these dispersed magnetic substances.

In the toner according to the present invention used as a two-component developer in the form of a mixture with a magnetic carrier, the magnetic carrier can be mixed so as to be a content of the toner is 2% by mass or more and 15% by mass or less in the developer.

Figure 8:
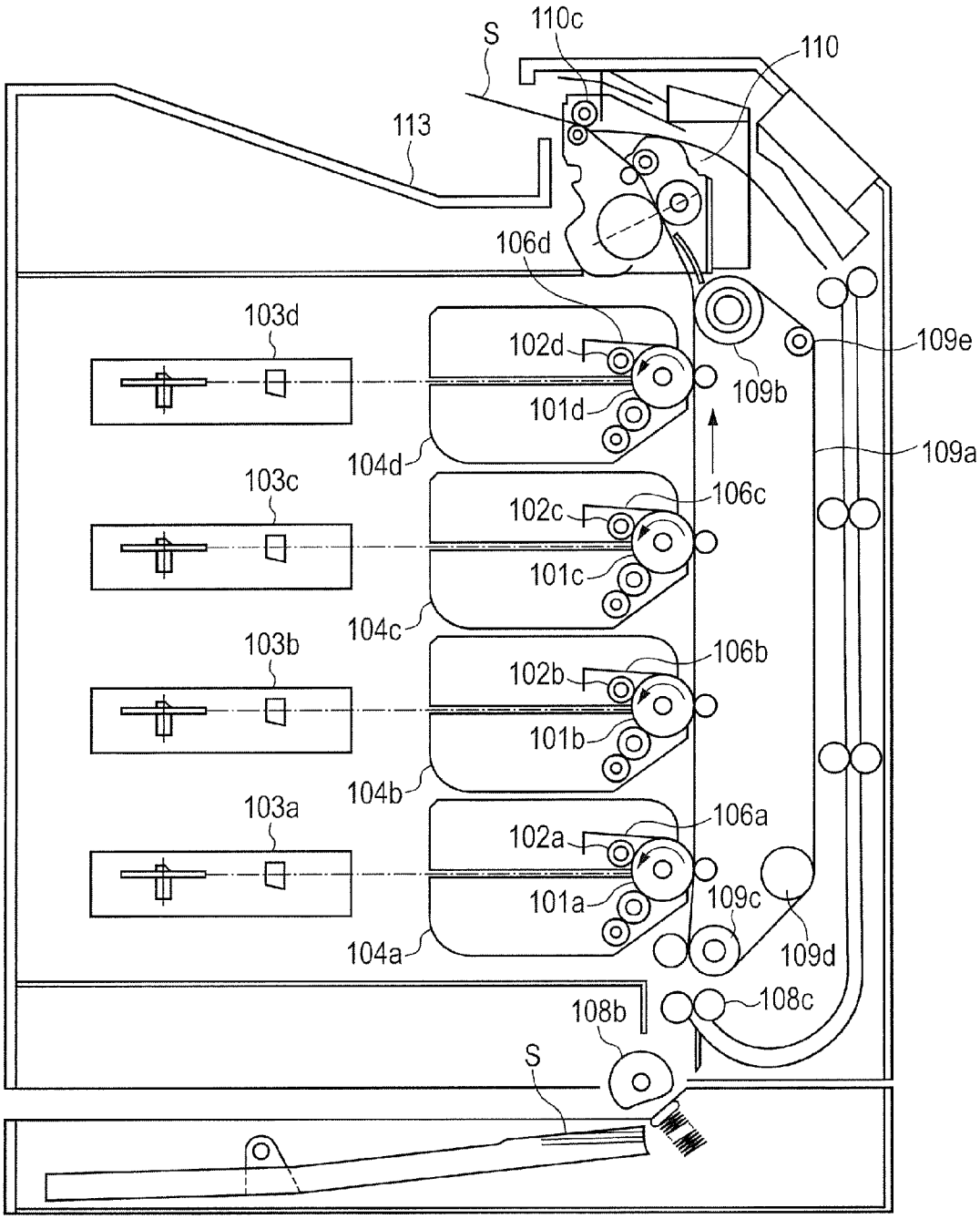
FIG. 8 is a schematic configuration diagram illustrating a configuration according to one embodiment of an image forming apparatus.

An example of an imaging method (contact one-component developing system) will now be described with reference to FIGS. 8 and 9. FIG. 8 illustrates a photosensitive drum (image bearing member, electrophotographic photosensitive member) 101 (101*a* to 101*d*) rotating in the arrow direction illustrated (counterclockwise) at a predetermined process speed. The photosensitive drums 101*a*, 101*b*, 101*c*, and 101*d* carry color images of a yellow (Y) component, a magenta (M) component, a cyan (C) component, and a black (Bk) component, respectively. These photosensitive drums 101*a* to 101*d* are driven by a drum motor (DC servomotor) not illustrated to be rotated. The photosensitive drums 101*a* to 101*d* may each independently have a driving source. The rotation drive by the drum motor is controlled by a digital signal processor (DSP) not illustrated, and other operations are controlled by a CPU not illustrated. An electrostatically adsorptive transfer belt 109*a* extends around a driving roller 109*b*, fixing rollers 109*c* and 109*e*, and a tension roller 109*d*. The transfer belt 109*a* is rotatable driven by the driving roller 109*b* in the arrow direction illustrated to transfer a transfer medium S (recording medium S) adsorbed thereon.

Among the four colors, an example using yellow (Y) will now be described. The photosensitive drum 101*a*, while rotating, is homogeneously primarily charged to a predetermined polarity and potential by a primary charging unit 102*a*. The photosensitive drum 101*a* is exposed to light from a laser beam exposing unit (hereinafter referred to as scanner) 103*a* to form an electrostatic latent image on the photosensitive drum 101*a* corresponding to the image information. Next, a toner image is formed on the photosensitive drum 101*a* by a developing unit 104*a* to visualize the electrostatic latent image. The same steps are also performed using other three colors (magenta (B), cyan (C), and black (Bk)) respectively.

The toner images of the four colors are sequentially transferred onto a recording medium S in the respective nips between the photosensitive drums 101*a* to 101*d* and the electrostatically adsorptive transfer belt 109*a* in synchronization with sending of the recording medium S transferred at a predetermined timing from the sheet feed roller 108*b*. The recording medium S is halted or resent by a resist roller 108*c* to be synchronized with transferring of the toner image. Simultaneously, residues such as untransferred toners on the photosensitive drums 101*a* to 101*d* after transfer of the toner images onto the recording medium S are removed by the respective cleaning units 106*a*, 106*b*, 106*c*, and 106*d*, and the photosensitive drums are repeatedly used in image formation. The recording medium S having the toner images transferred from the four photosensitive drums 101*a* to 101*d* is separated from the electrostatically adsorptive transfer belt 109*a* in the driving roller 109*b*, and is fed to a fixing unit 110. The toner image is fixed in the fixing unit 110, and the recording medium S is discharged onto a discharge tray 113 by a discharging roller 110*c*.

Figure 9:
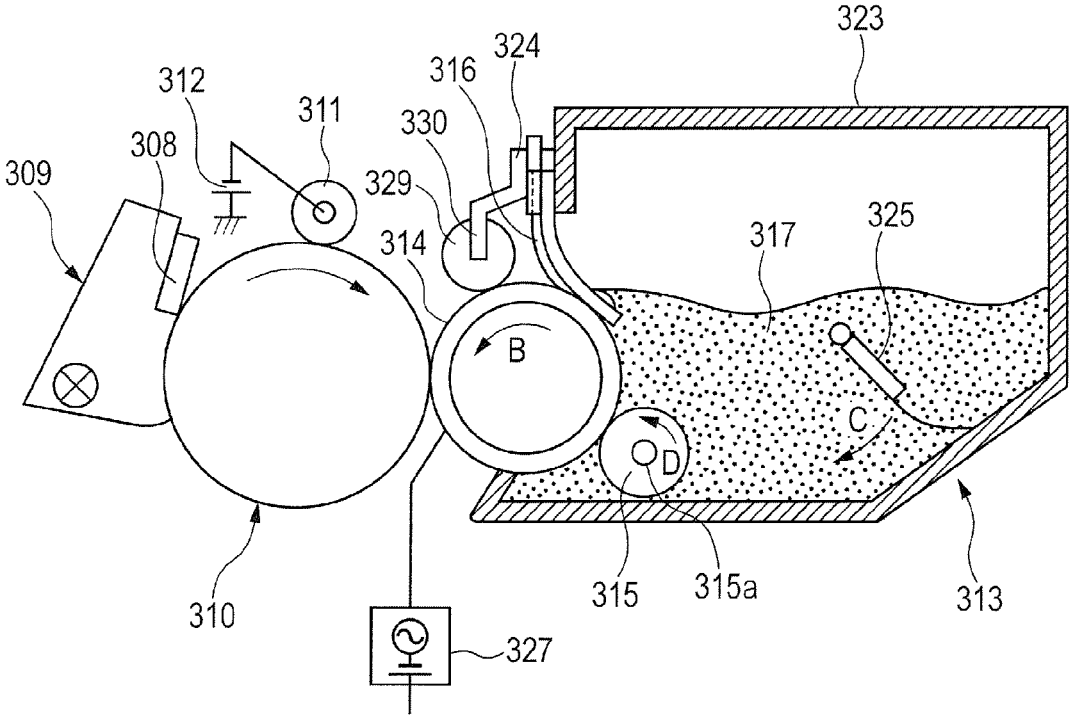
FIG. 9 is an enlarged cross-sectional view illustrating a configuration of a developing unit.

A specific example of an imaging method using a non-magnetic one-component contact developing system will now be described with reference to an enlarged view of a developing unit (FIG. 9). In FIG. 9, a developing unit 313 includes a developer container 323 accommodating a non-magnetic toner 317 as a one-component developer, and a toner carrier 314 disposed in an opening of the developer container 323 to extend in the longitudinal direction, face the photosensitive drum 310, and rotate in the direction of Arrow B (counterclockwise). A toner 317 is transferred toward the photosensitive drum by a toner transfer member 325 rotating in the direction of Arrow C (clockwise). The developing unit 313 develops the electrostatic latent image on the photosensitive drum 310 to form a toner image. The photosensitive drum contact charging member 311 is in contact with the photosensitive drum 310. A bias is applied to the photosensitive drum contact charging member 311 by a power supply 312. The toner carrier 314 is laterally disposed in the opening such that the right half circumferential surface of the toner carrier in FIG. 9 is located inside the developer container 323 and the left half circumferential surface thereof is exposed to the outside from the developer container 323. The exposed surface from the developer container 323 is in contact with the photosensitive drum 310 located in the left of the developing unit 313 in the drawing as illustrated in FIG. 9. The toner carrier 314 is rotatably driven in the direction of Arrow B. The circumferential velocity of the photosensitive drum 310 is 300 mm/s, and the circumferential velocity of the toner carrier 314 is 1 to 2 times that of the photosensitive drum 310.

A regulating member 316 is disposed above the toner carrier 314, and is supported by a regulating member supporting sheet metal 324. The regulating member 316 includes a substrate formed of a metal plate of SUS, a rubber material such as urethane and silicone, SUS having spring elasticity, or a metal thin plate of phosphor bronze, and a rubber material bonded to the contact surface side of the substrate to be brought into contact with the toner carrier 314. The direction of contact is a counter direction so that the tip of the regulation member 316 is located at upstream in the rotation direction of the toner carrier 314 with respect to a contacting position. The tip of the free end of the regulating member 316 is arranged in counter direction against the rotating direction of the toner carrier 314. Namely, the tip of the free end of the regulating member 316 is pressed against the upstream portion of the toner carrier 314, the tip of the fixed end of the regulating member 316 is arranged via a space to the downstream portion of the toner carrier 314. In an exemplary regulating member 316, an urethane rubber sheet having a thickness of 1.0 mm is bonded to the regulating member supporting sheet metal 324, and the contact pressure (linear pressure) to the toner carrier 314 is appropriately set. The contact pressure can be 20 to 300 N/m. The contact pressure is determined as follows: Three metal thin plates having a known friction coefficient are placed in the contact region, and the middle plate is pulled out with a spring scale. The obtained value is converted into the contact pressure. A regulating member 316 having a rubber material bonded to the contact surface side thereof can be used to attain adhesion to the toner because the rubber material can prevent fusing and fixation of the toner to the regulating member in long-term use. The tip of the regulating member 316 can also be brought into edge contact with the toner carrier 314. In edge contact, the contact angle of the regulating member 316 to the tangent of the toner carrier at the contact point of the toner carrier can be set to be 40° or less to significantly regulate the layer of the toner. A toner feed roller 315 rotating in the direction of Arrow D (counterclockwise) (axis 315*a* of the toner feed roller) is in contact with the surface of the toner carrier 314 at upstream in the rotation direction of the toner carrier 314 with respect to the contact region between the regulating member 316 and the surface of the toner carrier 314, and is rotatably supported. At a contact width of 1 to 8 mm, the toner feed roller 315 can be effectively brought into contact with the toner carrier 314, and can have a relative speed to the toner carrier 314 in the contact region.

A charging roller 329 is not an essential component, and can be disposed. The charging roller 329 is formed of an elastic material such as nitrile rubber (NBR) or silicone rubber, and is attached to a pressing member 330. The contact load applied to the toner carrier 314 of the charging roller 329 by the pressing member 330 is set at 0.49 to 4.9 N. The charging roller 329 is brought into contact with the toner carrier 314 to fully apply the toner on the toner layer on the toner carrier 314, so that the toner carrier 314 is homogeneously coated with the toner. The regulating member 316 and the charging roller 329 can be disposed such that the toner carrier 314 is surely covered with the charging roller 329 in the longitudinal direction corresponding to the contact region between the toner carrier 314 and the regulating member 316. The charging roller 329 is essentially driven following the toner carrier 314 or is driven at the same circumferential velocity as that of the toner carrier 314. A difference in the circumferential velocity between the charging roller 329 and the toner carrier 314 causes an uneven coating of the toner, which undesirably causes uneven images. A DC bias is applied to the charging roller 329 or between the toner carrier 314 and the photosensitive drum 310 by a power supply 327. A non-magnetic toner 317 on the toner carrier 314 is charged by discharge from the charging roller 329. The bias applied to the charging roller 329 has the same polarity as that of the non-magnetic toner, and is equal to or more than the initial voltage of discharge. The bias is set such that the difference in potential between the toner carrier 314 and the charging roller 329 is 1000 to 2000 V. The thin toner layer formed on the toner carrier 314 is charged by the charging roller 329, and is uniformly transferred to a developing region facing the photosensitive drum 310. In the developing region, the thin toner layer formed on the toner carrier 314 is transferred to the electrostatic latent image on the photosensitive drum 310, and is developed into a toner image by the DC bias applied to the toner carrier 314 and the photosensitive drum 310 by the power supply 327 illustrated in FIG. 9. After the toner image is transferred onto a transfer medium or a transfer member, the residual toner on the photosensitive drum 310 is cleaned by the cleaning blade 308 in the cleaning unit 309.

In this example, the cleaning blade 308 is held with ends of a support formed of a sheet metal. The cleaning blade 308 is disposed substantially in parallel to the photosensitive drum 310 in the longitudinal direction. One end of the cleaning blade 308 in the short direction is fixed to one end of the support, and the other free end of the cleaning blade 308 in the short direction is pressed against the photosensitive drum 310. The cleaning blade 308 is arranged so as to be in the counter direction with respect to the rotation direction of the photosensitive drum 310.

The cleaning blade is suitably formed of rubber materials, which readily follow to the surface of the photosensitive member and barely scratch the surface of the photosensitive member. Among these rubber materials, polyurethane rubber is most suitable in view of physical properties and chemical durability. The rubber material for the cleaning blade can have an international rubber hardness degree (IRHD) of 60° or more and 90° or less to attain stable cleaning of the toner from the photosensitive member.

The cleaning properties are significantly affected by the contact angle and the contact linear pressure of the cleaning blade to be set. The cleaning rubber blade can be fixed to a support disposed 15° or more and 45° or less oblique to the tangent of the photosensitive member in the contact position between the cleaning blade and the photosensitive member, and the cleaning blade can be pressed so as to be in the counter direction with respect to the rotation direction of the photosensitive member.

The contact pressure of the cleaning blade pressed against the photosensitive member (linear pressure per unit length in the contact region in the longitudinal direction) is preferably set at 30 N/m or more and 105 N/m or less to prevent escape of the toner and chipping of the blade after long-term use at a high process speed. The contact pressure is more preferably 30 N/m or more and 90 N/m or less. The contact linear pressure can be measured with a load converter (load cell) installed in a place to which the cleaning blade is fixed. In the measurement of the contact pressure, the load convertor may be installed in a modified cleaning apparatus in an image forming apparatus. The contact pressure can be readily measured with a HEIDON friction tester made by Shinto Scientific Co., Ltd. (modified Tribostation TYPE32).

The contact angle and the contact linear pressure between the cleaning blade and the photosensitive drum in the present invention refer to those determined during a static state of the photosensitive drum.

The photosensitive drum used in the imaging method according to the present invention can have a diameter of 20 mm or more and 50 mm or less to attain a compact, high-speed electrophotographic apparatus.

<Method of Determining Average Circularity of Toner>

The average circularity of the toner is measured with a flow type particle image analyzer "FPIA-3000" (made by Sysmex Corporation) on the condition of measurement and analysis during calibration.

The average circularity of the toner is specifically measured by the following procedure. First, deionized water (about 20 mL), from which solid products or impurities are preliminarily removed, is placed in a glass container. A dispersant "CONTAMINON N" (aqueous solution of 10% by mass neutral detergent (pH: 7) for washing apparatuses for precise measurement containing a nonionic surfactant, an anionic surfactant, and an organic builder, made by Wako Pure Chemical Industries, Ltd.) is diluted about 3 mass times with deionized water. The diluted solution (about 0.2 mL) is added to the deionized water in the container. A sample for measurement (about 0.02 g) is added, and is dispersed with an ultrasonic disperser for two minutes to prepare a dispersion for measurement. At this time, the dispersion is appropriately cooled to a temperature of 10° C. or more and 40° C. or less. The ultrasonic disperser used is a desktop ultrasonic washing dispersing machine (such as "VS-150" (made by VELVO-CLEAR K.K)) having an oscillating frequency of 50 kHz and an electrical output of 150 W. A predetermined amount of deionized water is added in a water bath, and the CONTAMINON N (about 2 mL) is added in the water bath.

The measurement is performed with the flow type particle image analyzer installed with an object lens "UplanApo" (magnification: 10 times, the number of openings: 0.40) and a particle sheath "PSE-900A" (made by Sysmex Corporation) as a sheath solution. The dispersion prepared according to the procedure is introduced into the flow type particle image analyzer, and 3000 toner particles are measured in a total count mode of an HPF measurement mode. The binarized threshold in particle analysis is set at 85%, and the analyzed particle diameter is restricted to an equivalent circle diameter of 1.985 μm or more and less than 39.69 μm to determine the average circularity of the toner.

Prior to the measurement, automatic focusing is performed with a standard latex particle (such as "RESEARCH AND TEST PARTICLES Latex Microsphere Suspensions 5200A" made by Thermo Fisher Scientific Inc. diluted with deionized water). After the measurement is started, the focusing can be performed every two hours.

In Examples of this application, the average circularity of the toner was measured with a flow type particle image analyzer having a calibration certificate issued by Sysmex Corporation, which guarantees a calibration service by Sysmex Corporation. The measurement was performed on the same measurement and analysis conditions as those when certified except that the analyzed particle diameter was restricted to an equivalent circle diameter of 1.985 μm or more and less than 39.69 μm.

<Method of Determining Number Average Particle Diameter (D1) of External Additive>

The number average particle diameter (D1) of the external additive is measured with a scanning electron microscope "S-4800" (trade name, made by Hitachi High-Technologies Corporation). A toner with an externally added external additive is observed with the scanning electron microscope. In a view field enlarged (maximum: 200000 times), the long diameters of 100 primary particles of the external additive are measured at random to determine the number average particle diameter (D1). In the observation, the magnification is appropriately adjusted according to the dimension of the external additive.

<Method of Determining Coverage Ratio of Surface of Organic-Inorganic Composite Fine Particle Covered with Inorganic Fine Particle B>

The coverage ratio of the surface of the organic-inorganic composite fine particle covered with the inorganic fine particle B is measured by electron spectroscopy for chemical analysis (ESCA). If the inorganic fine particle B is a silica particle, the coverage ratio is calculated from the amount of a silicon (hereinafter abbreviated to Si) atom derived from silica. ESCA is an analysis method which detects atoms in a region ranging from the sample surface to a depth of several nanometers or less. For this reason, the atoms on the surface of the organic-inorganic composite fine particle can be detected.

The apparatus includes a platen of a 75 mm square (with a screw hole for fixing a sample (diameter of about 1 mm)), and the platen was used as a sample holder. The screw hole of the platen is a through hole, which is filled with a resin to produce a depression portion (depth: about 0.5 mm) for measuring powder. A sample for measurement was charged into the depression portion and leveled off with a spatula or the like to prepare a sample.

ESCA is performed with the following apparatus on the following measurement conditions.

apparatus used: Quantum 2000 made by ULVAC-PHI, Inc.
analysis method: narrow analysis
measurement conditions:
X-ray source: Al-Kα
conditions on X rays: 100 μl, 25 W, 15 kV
incoming photo electron angle: 45°
PassEnergy: 58.70 eV
range for measurement: ϕ100 μm The measurement was performed on the above conditions.

In the analysis method, first, the peak derived from a C—C bond in the is orbital of a carbon atom is corrected to 285 eV. From the peak area derived from the 2p orbital of a silicon atom in which the peak tops are detected at 100 eV or more and 105 eV or less, the amount of Si derived from silica in the total amount of constitutional elements is calculated using a relative sensitivity factor provided by ULVAC-PHI, Inc.

First, the organic-inorganic composite fine particle is measured. The particle of an inorganic component used in preparation of the organic-inorganic composite fine particle is also measured by the same method. If the inorganic component is silica, the proportion of "the amount of Si in measurement of the organic-inorganic composite fine particle" to "the amount of Si in measurement of the silica particle" is defined as the ratio of the inorganic fine particle B present on the surface of organic-inorganic composite fine particle according to the present invention. In this measurement, a sol gel silica particle (number average particle diameter: 110 nm) was used as the silica particle, and the proportion was calculated.

An example where the inorganic fine particle B is a silica particle has been described. If the inorganic fine particle is not a silica particle, the type of the metal contained in the inorganic fine particle may be specified from the database attached to the measurement apparatus to analyze the metal.

<Coverage Ratio of Surface of the Toner Particle Covered with Fine Particle A>

The coverage ratio of the surface of the toner particle covered with the fine particle A is calculated from the amount of the atom derived from the inorganic fine particle, which is determined by electron spectroscopy for chemical analysis (ESCA).

The sample holder, the ESCA apparatus, and the measurement conditions are the same as those in <Method of determining coverage ratio of surface of organic-inorganic composite fine particle covered with inorganic fine particle B>.

An example in which silica is used as the fine particle A will now be described.

In the analysis method, first, the peak derived from a C—C bond in the is orbital of a carbon atom is corrected to 285 eV. From the peak area derived from the 2p orbital of a silicon atom in which the peak tops are detected at 100 eV or more and 105 eV or less, the amount of Si derived from silica in the total amount of constitutional elements is calculated using a relative sensitivity factor provided by ULVAC-PHI, Inc.

A toner having externally added silica is measured by ESCA to determine the amount of Si derived from silica in the total amount of constitutional elements. Next, a single substance of silica used in the toner is measured to determine the amount of Si derived from silica in the total amount of constitutional elements. The amount of Si determined as a single substance of silica is defined as 100% of the coverage ratio of the surface of the toner covered with the external additive. The proportion of the amount of Si in the measurement of the toner to the amount of Si in the measurement of a single substance of silica is defined as the coverage ratio in the present invention.

If the organic-inorganic composite fine particle is used as the fine particle A according to the present invention, the coverage ratio is determined by a different procedure from that described above.

An exemplary method will be described in which the inorganic fine particle B in the organic-inorganic composite fine particle is silica. (1) First, only an organic-inorganic composite fine particle is externally added to the surface of the toner particle to determine the amount of Si derived from silica by ESCA. Next, a single substance of the organic-inorganic composite fine particle is measured by ESCA on the above conditions to determine the amount of Si derived from silica. The coverage ratio of the surface of the toner particle covered with the organic-inorganic composite fine particle is determined. Five samples are prepared by externally adding this organic-inorganic composite fine particle alone in different amounts, and calibration curves of the coverage ratios of the organic-inorganic composite fine particle are produced.

(2) Next, a desired amount (parts by mass) of the organic-inorganic composite fine particle is externally added to the surface of the toner to determine the amount of Si derived from silica by ESCA (measured value).

(3) From the calibration curves of the organic-inorganic composite fine particle produced in (1) described above, the coverage ratio of the surface of the toner particle covered with the organic-inorganic composite fine particle is determined.

An example where the fine particle A includes a silica particle has been described. If the fine particle A does not include a silica particle, the type of the metal contained in the fine particle A may be specified from the database attached to the measurement apparatus to analyze the metal.

If a particle containing the same metal is present besides the target particle, first a model toner is prepared by externally adding the non-target particle alone in the same amount. The model toner is measured by ESCA to determine the amount of the metal. The amount is subtracted from the amount of the metal determined from the actual measurement of the toner to determine the coverage ratio.

<Variation Coefficient of the Number of Fine Particle a on Surface of Toner>

The variation coefficient indicating the state of the fine particle A present on the surface of the toner particle S is confirmed with a scanning electron microscope.

Figure 2:
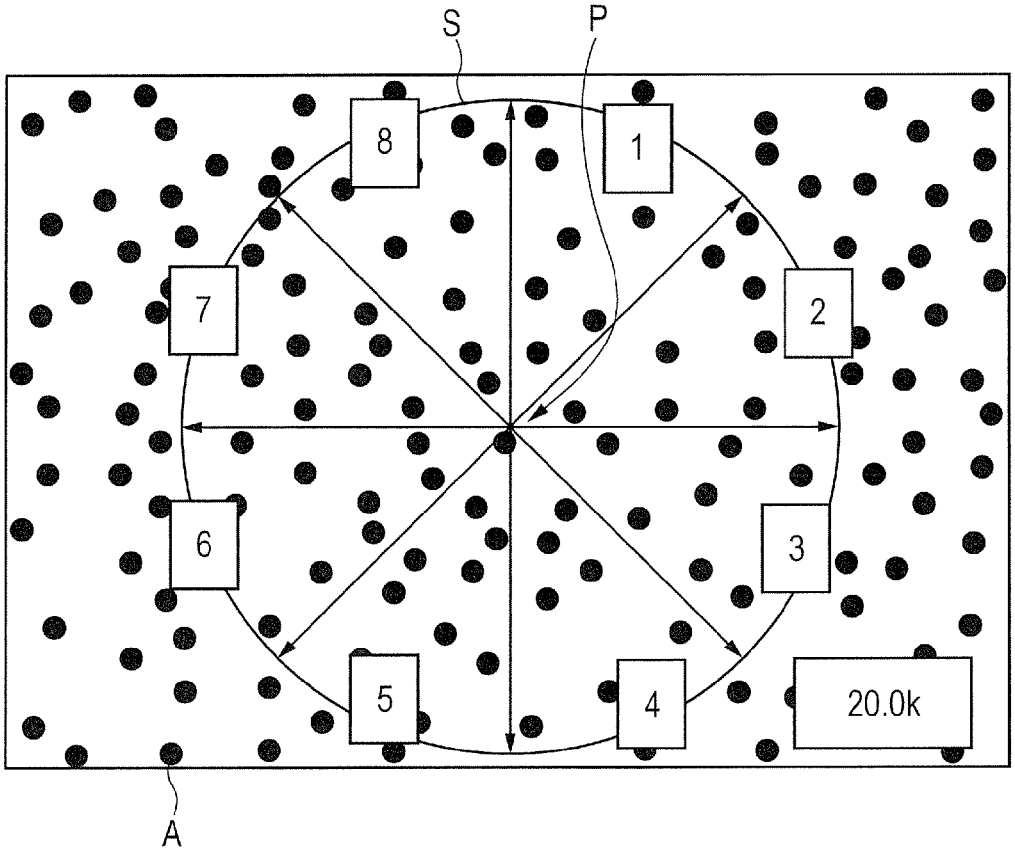
FIG. 2 is an electron microscopic conceptual drawing in determination of a variation coefficient.

Namely, as illustrated in FIG. 2, the toner particle in a backscattered electron image observed with a scanning electron microscope is photographed at a magnification of 20000 times. The photographed image is taken into image processing software. A reference point P is placed in the projection surface of the toner particle, and a circle having a radius of 2 μm (radius of 4 cm in the image 20000 times enlarged) is drawn around the reference point P as the center point. The reference point P may be located at any place in the backscattered electron image of the toner as long as a circle having a radius of 2 μm can be drawn in the backscattered electron image.

Next, in the backscattered electron image of the toner particle photographed at a magnification of 20000 times, straight lines are drawn from the reference point P (center point) of the projection surface of the toner particle to the outer periphery of the projection surface of the toner particle by 45° to divide the circle into eight regions.

The numbers of the fine particle A observed in the eight divided regions are counted, and the averages in the respective regions are calculated. The standard deviation is then calculated. The variation coefficient is then calculated from the following equation.

$$\text{(variation coefficient)}=\text{(standard deviation of the number of fine particle } A\text{)/(average number)}$$

Namely, the variation coefficient of the number of fine particle A on the surface of the toner particle S specified in the present invention refers to a variation coefficient of the number of the fine particle A present in the regions (0.5 $\pi\mu m^2$) defined by dividing a circle having a radius of 2 μm into eight.

<Method of Measuring Fixing Rate of Fine Particle A>

Sucrose (made by KISHIDA CHEMICAL Co., Ltd., 160 g) is added to deionized water (100 mL) in a container, and is dissolved while the container is placed in a hot water. A concentrated sucrose solution is prepared. The concentrated sucrose solution (31 g) and a CONTAMINON N (aqueous solution of a 10% by mass neutral detergent (pH: 7) for washing apparatuses for precise measurement containing a nonionic surfactant, an anionic surfactant, and an organic builder, made by Wako Pure Chemical Industries, Ltd.) (6 mL) are placed in a tube for centrifugation to prepare a dispersion. A toner (toner particle treated with the fine particle A) (1 g) is added to the dispersion, and aggregates of the toner are dissolved with a spatula or the like.

The tube for centrifugation is shaken with a shaker at 350 rpm for 20 minutes. After the shaking, the solution is placed into a glass tube (50 mL) for a swing rotor to be separated with a centrifuge at 3500 rpm for 30 minutes. It is visually checked that the toner is sufficiently separated with the aqueous solution, and the topmost layer (separated toner) of the solution is extracted with a spatula or the like. The extracted aqueous solution containing the toner is filtered through a reduced pressure filter, and is dried with a dryer for one hour or more. The dried product is crushed with a spatula, and the amount of the external additive is measured with fluorescent X rays (aluminum ring diameter: 10 mm). The fixing rate (%) is calculated from the amount of the fine particle A of the toner after washing with water and the amount of the fine particle A of the initial toner.

The each elements are measured with fluorescent X rays according to JIS K 0119-1969 and specifically, measured as follows.

The measurement apparatus used is a wavelength dispersion fluorescent X-ray analyzer "Axios" (made by PANalytical V.B.) with the attached dedicated software "SuperQ ver. 4.0F" (made by PANalytical V.B.) for setting of the measurement conditions and analysis of the measured data. Rh is used as an anode of an X-ray tube. The atmosphere for measurement is in vacuum. The measurement diameter (diameter of a collimator mask) is 10 mm, and the measurement time is 10 seconds. A light element is detected with a proportional counter (PC), and a heavy element is detected with a scintillation counter (SC).

The sample used in the measurement is a pellet prepared as follows: the toner after washing with water and the initial toner (about 1 g) are placed in an aluminum ring for a dedicated press respectively, and are leveled off, and are pressurized into a thickness of about 2 mm with a tablet press machine "BRE-32" (made by Maekawa Testing Machine Mfg. Co., LTD.) at 20 MPa for 60 seconds.

The measurement is performed on the above conditions to identify the element based on the obtained peak position of the X ray. The concentration of the element is calculated from the counting rate (unit: cps) as the number of the X-ray photons per unit time.

The amount of $SiO_2$ in the toner is determined as follows: a silica ($SiO_2$) fine particle is added in an amount of 0.10 parts by mass to the toner particle (100 parts by mass), and is sufficiently mixed in a coffee mill. Similarly, a silica fine particle is separately mixed with a toner particle in an amount of 0.20 parts by mass and in an amount of 0.50 parts by mass to prepare samples for calibration curves.

The respective samples are formed into sample pellets for calibration curves with a tablet press machine as described above, and the counting rate (unit: cps) of Si-Kα rays observed at a diffraction angle (2θ)=109.08° using pentaerythritol (PET) as an analyzing crystal is measured. At this time, the X-ray generator has an accelerating voltage of 24 kV and a current value of 100 mA. Calibration curves of linear functions are produced where the obtained counting rate of X rays is plotted as the ordinate and the amount of $SiO_2$ added in the sample for a calibration curve is plotted as the abscissa.

Next, the target toner for analysis is formed into a pellet with a tablet press machine as described above to measure the counting rate of Si-Kα rays. The content of $SiO_2$ in the toner is determined from the calibration curves described above.

The ratio of the amount of the fine particle A in the toner after washing with water to the amount of the fine particle A in the initial toner, which are calculated by the above method, is determined, and is defined as the fixing rate (%) of the fine particle A.

<Method of Measuring True Density of Toner>

The true density of the toner is measured with an automatic dry densitometer Automatic Pycnometer (made by Quantachrome Instruments Inc.). The conditions are as follows.

cell: SM cell (10 mL)

amount of the sample: 2.0 g

This measurement apparatus measures the true density of a solid or a liquid according to gas displacement. The gas displacement, which is also based on Archimedes' principle as well as liquid displacement, attains highly accurate measurement because a gas (argon gas) is used as a medium for displacement.

<Method of Measuring Weight Average Particle Diameter (D4) of Toner>

The weight average particle diameter (D4) of the toner is determined as follows: the toner is measured according to the pore electric resistance method with a precise particle diameter distribution analyzer "Coulter Counter Multisizer 3" (registered trademark, made by Beckman Coulter, Inc.) equipped with an aperture tube (100 μm) and the attached dedicated software "Beckman Coulter Multisizer 3 Version 3.51" (made by Beckman Coulter, Inc.) for setting of the measurement conditions and analysis of data. The measurement is performed with the number of effective measurement channels of 25000 channels. The obtained data is analyzed to determine the weight average particle diameter (D4) of the toner.

An electrolytic aqueous solution can be used, for example, a solution of about 1% by mass super grade sodium chloride in deionized water, such as "ISOTON II" (made by Beckman Coulter, Inc.).

Prior to the measurement and analysis, the dedicated software is set as follows.

In the screen "Change Standard Measurement Method (SOMME)" of the dedicated software, the total count number in the control mode is set at 50000 particles, the number of measurements is set at 1, and the Kd value is set at the value obtained using "Standard particle (10.0 μm)" (made by Beckman Coulter, Inc.). A button to measure the threshold/noise level is pressed to automatically set the threshold and the noise level. The current is set at 1600 μA, and the gain is set at 2. The electrolyte solution is set at ISOTON II. "Flush aperture tube after measurement" is checked.

In the screen "Setting of conversion from pulse to particle diameter" of the dedicated software, the bin interval is set at a logarithmic particle diameter, the number of particle diameter bins is set at 256, and the particle diameter range is set from 2 μm to 60 μm.

A specific procedure for the measurement will be described below.

(1) An the electrolytic aqueous solution (about 200 mL) is placed in a 250 mL round-bottomed glass beaker dedicated to Multisizer 3. The beaker is installed in a sample stand to perform measurement with a stirrer rod rotating counterclockwise at 24 rotations/sec. The dirt and air bubbles in the aperture tube are removed using the "Flush aperture" function of the analysis software.

(2) The electrolytic aqueous solution (about 30 mL) is placed in a 100 mL flat-bottom glass beaker. A dispersant "CONTAMINON N" (aqueous solution of 10% by mass neutral detergent (pH: 7) for washing apparatuses for precise measurement containing a nonionic surfactant, an anionic surfactant, and an organic builder, made by Wako Pure Chemical Industries, Ltd.) is diluted about 3 mass times with deionized water. The diluted solution (about 0.3 mL) is added to the electrolytic aqueous solution.

(3) Deionized water (3.3 L) is placed in a water bath of an ultrasonic disperser "Ultrasonic Dispersion System Tetora 150" (made by Nikkaki-Bios Co., Ltd.) having two incorporated oscillators (oscillating frequency: 50 kHz) with the phase of one oscillator being shifted 180° from that of the other oscillator. The CONTAMINON N (about 2 mL) is placed in the water bath.

(4) The beaker in (2) is installed on a hole for fixing a beaker in the ultrasonic disperser to operate the ultrasonic disperser. The height of the beaker is adjusted so as to maximize the oscillating state of the surface of the electrolytic aqueous solution in the beaker.

(5) While the electrolysis aqueous solution in the beaker in (4) is irradiated with ultrasonic waves, the toner (about 10 mg) is added little by little to the electrolysis aqueous solution, and is dispersed. The ultrasonic dispersion treatment is continued for another 60 seconds. During the ultrasonic dispersion, the temperature of water in the water bath is appropriately adjusted to 10° C. or more and 40° C. or less.

(6) The electrolytic aqueous solution having the dispersed toner (5) is added dropwise to the round-bottomed beaker set on the sample stand in (1) with a pipette, and the concentration for measurement is adjusted to about 5%. The measurement is performed until the number of particles measured reaches 50000.

(7) The data measured is analyzed with the dedicated software attached to the analyzer, and the weight average particle diameter (D4) is calculated. When graph/volume % is set with the dedicated software, the "Average diameter" on the screen "Analysis/volume statistical value (arithmetic average)" indicates the weight average particle diameter (D4).

EXAMPLES

The basic configuration and features of the present invention have been described. The present invention will now be specifically described by way of Examples. Embodiments according to the present invention, however, will not be limited by these Examples. In Examples, the term "parts" means parts by mass.

Production Example of the fine particle A will be described.

Production Example of Sol Gel Silica Particle

Methanol (590.0 g), water (42.0 g), and 28% by mass aqueous ammonia (48.0 g) were placed in a 3-L glass reactor equipped with a stirrer, a dropping funnel, and a thermometer, and were mixed. The mixed solution was adjusted to 35° C. Under stirring, addition of tetramethoxysilane (1100.0 g, 7.23 mol) and 5.5% by mass aqueous ammonia (395.0 g) were simultaneously started. Tetramethoxysilane was added dropwise over 6 hours, and aqueous ammonia was added dropwise over 5 hours. After addition was over, the solution was continuously stirred for 0.5 hours for hydrolysis to prepare a dispersion of a hydrophilic spherical sol gel silica fine particle in methanol and water. An ester adaptor and a cooling tube were attached to a glass reactor, and the dispersion was sufficiently dried at 80° C. under reduced pressure. The resulting silica particle was heated in a thermostat at 400° C. for 10 minutes.

The silica particle obtained was crushed with a pulverizer (made by Hosokawa Micron Corporation).

The silica particle (500 g) was then placed in a stainless steel autoclave (inner volume: 1000 ml) with an inner tube of polytetrafluoroethylene. The autoclave was purged with nitrogen gas. While a stirring blade attached to the autoclave was being rotated at 400 rpm, hexamethyldisilazane (HMDS, 0.5 g) and water (0.1 g) were homogeneously sprayed onto silica powder in misty with a two-fluid nozzle. After stirring for 30 minutes, the autoclave was sealed, and was heated at 220° C. for two hours. The inner pressured of the system was reduced while the autoclave was being heated, to perform deammoniation treatment. A sol gel silica particle (Fine particle A-1) was prepared.

Sol gel silica particles having a different particle diameter were prepared by varying the amounts of the raw materials at the same ratio of the raw materials and varying the time for addition of the raw materials at the same addition rates of the materials. The physical properties of the respective sol gel silica particles are shown in Table 1.

Production Example of Organic-Inorganic Composite Fine Particle

The organic-inorganic composite fine particle can be prepared according to the description in Examples of WO 2013/063291.

The organic-inorganic composite fine particle used in Examples described later was prepared according to Example 1 of WO 2013/063291 using silica shown in Table 1. The physical properties of the organic-inorganic composite fine particle are shown in Table 1.

The organic-inorganic composite fine particle prepared was formed of a base particle of a methacryloxypropyltrimethoxysilane polymer and a silica fine particle embedded into the surface thereof, part of the silica fine particle forming a convex portion on the surface of the organic-inorganic composite fine particle. The part of the silica fine particle was exposed.

TABLE 1

| Fine particle A | | | | | | |
|---|---|---|---|---|---|---|
| | | Organic-inorganic composite fine particle | | Number | | |
| Type | Inorganic fine particle | Particle diameter of colloidal silica in organic-inorganic composite fine particle (nm) | Content (% by mass) of inorganic fine particle | average particle diameter (nm) | SF-1 | SF-2 |
| Fine particle A-1 | Sol gel silica | — | — | 100 | 101 | 101 |
| Fine particle A-2 | | — | — | 80 | 101 | 100 |
| Fine particle A-3 | | — | — | 200 | 101 | 101 |
| Fine particle A-4 | | — | — | 400 | 101 | 100 |
| Fine particle A-5 | Titanium oxide | — | — | 90 | 103 | 102 |
| Fine particle A-6 | Alumina | — | — | 110 | 102 | 103 |
| Fine particle A-7 | — | 9 | 14 | 120 | 115 | 104 |
| Fine particle A-8 | — | 26 | 60 | 96 | 108 | 111 |
| Fine particle A-9 | Sol gel silica | — | — | 60 | 101 | 100 |
| Fine particle A-10 | | — | — | 450 | 101 | 101 |

SF-1 and SF-2 are determined based on the primary particle.

Production Example of Titanium Oxide Fine Particle

The titanium oxide fine particle used was a titania fine particle (100 parts, BET specific surface area: 32 $m^2/g$, number average particle diameter (D1) of the primary particle: 90 nm) treated with isobutyltrimethoxysilane (10 parts). The physical properties of the titanium oxide fine particle are shown in Table 1.

Production Example of Alumina Fine Particle

The alumina fine particle used was an alumina fine particle (100 parts, BET specific surface area: 28 $m^2/g$, number average particle diameter (D1) of the primary particle: 110 nm) treated with isobutyltrimethoxysilane (10 parts). The physical properties of the alumina fine particle are shown in Table 1.

<Second External Additive>

As a second external additive, an inorganic fine particle shown in Table 2 below was prepared.

TABLE 2

| Second inorganic fine particle | | | | |
|---|---|---|---|---|
| Type | Number average particle diameter (nm) | BET specific surface area ($m^2/g$) | SF-1 | Surface treatment |
| Silica fine particle 1 | 35 | 38 | 101 | Treatment with hexamethyldisilazane |
| Silica fine particle 2 | 10 | 140 | 103 | Treatment with hexamethyldisilazane and treatment with silicone oil |

SF-1 and SF-2 are determined based on the primary particle.

Production Example 1 of Toner Particle

Deionized water (710 parts) and an aqueous solution (850 parts) of 0.1 mol/L $Na_3PO_4$ were placed in a four-necked container. While the solution was being stirred with a high-speed stirrer TK-homomixer at 12,000 rpm, the solution was kept at 60° C. An aqueous solution (68 parts) of 1.0 mol/L-$CaCl_2$ was gradually added to the solution to prepare an aqueous dispersion medium containing a fine, poorly water-soluble dispersion stabilizer $Ca_3(PO_4)_2$.

| | |
|---|---|
| styrene | 122 parts |
| n-butyl acrylate | 36 parts |
| copper phthalocyanine pigment (Pigment Blue 15:3) | 13 parts |
| low molecular weight polystyrene (glass transition temperature = 55° C., Mw = 3,000, Mn = 1,050) | 40 parts |
| polyester resin (1) (terephthalic acid-propylene oxide modified bisphenol A (2 mol adduct) (molar ratio = 51:50), acid value = 10 mgKOH/g, glass transition temperature = 70° C., Mw = 10500, Mw/Mn = 3.20) | 10 parts |
| negative charging controller (aluminum compound of 3,5-di-tert-butylsalicylic acid) | 0.8 parts |
| wax (Fischer-Tropsch wax, endothermic main peak temperature = 78° C.) | 15 parts |

These materials were stirred with an Attritor for three hours to disperse the components in a polymerizable monomer. A monomer mixture was prepared. A polymerization initiator 1,1,3,3-tetramethylbutyl peroxy-2-ethylhexanoate (20.0 parts) (50% solution in toluene) was added to the monomer mixture to prepare a polymerizable monomer composition.

The polymerizable monomer composition was added to the aqueous dispersion medium, and was granulated for five minutes while the number of rotations of the stirrer was kept at 10,000 rpm. Subsequently, the high-speed stirrer was replaced by a propeller stirrer, and the inner temperature was raised to 70° C. The reaction was performed for six hours while the mixture was slowly being stirred.

In the next step, the inner temperature of the container was raised to 80° C., and was kept this temperature for four hours. The inner temperature was then gradually cooled to 30° C. at a cooling rate of 1° C./min to prepare Slurry 1. Diluted hydrochloric acid was placed in the container containing Slurry 1 to remove the dispersion stabilizer. The product was then filtered, was washed, and was dried to prepare a polymer particle (Toner particle 1) having a weight average particle diameter (D4) of 6.5 μm and an average circularity of 0.980. The toner particle had a true density of 1.1 g/cm$^3$.

Production Example 2 of Toner Particle

Toner particle 2 was prepared by emulsification association according to the description of Examples of WO 2013/146234. Toner particle 2 had a weight average particle diameter (D4) of 6.7 μm, an average circularity of 0.972, and a true density of 1.1 g/cm$^3$.

Production Example 3 of Toner Particle

Toner particle 3 was prepared by emulsion polymerization according to the description of Examples of Japanese Patent Application Laid-Open No. 2007-4086. Toner particle 3 had a weight average particle diameter (D4) of 6.0 μm, an average circularity of 0.975, and a true density of 1.1 g/cm$^3$.

Production Example 4 of Toner Particle

Toner particle 4 was prepared by suspension granulation according to the description of Examples of Japanese Patent Application Laid-Open No. 2007-108630. Toner particle 4 had a weight average particle diameter (D4) of 6.5 μm, an average circularity of 0.976, and a true density of 1.1 g/cm$^3$.

Example 1

Fine particle A-1 shown in Table 1 was added to Toner particle 1 (100 parts), and a treatment was performed with a surface modification apparatus illustrated in FIGS. 3 to 7C at a circumferential velocity of the blade tip of 40 m/sec for 300 seconds. The second external additive shown in Table 2 (Silica fine particle 1) was then added, and a treatment was performed with the surface modification apparatus at a circumferential velocity of the blade tip of 40 m/sec for 60 seconds. A coarse particle was removed through a 200-mesh sieve to prepare Toner 1.

The formulation and the physical properties of Toner 1 are as shown in Tables 3 and 4.

Toner 1 was used to perform the following evaluation test. The results of evaluation are shown in Table 5.

Examples 2 to 22, Comparative Examples 1 to 5

Toners 2 to 28 were prepared in the same manner as in Example 1 except that the formulation was varied as shown in Table 3. The physical properties of the toners are shown in Table 4. The evaluation was performed in the same manner as in Example 1, and the results of evaluation are shown in Table 5.

TABLE 3

| | Toner particle | | Formulation of external additive | | | | |
|---|---|---|---|---|---|---|---|
| | Type | Average circularity | Type of first external additive | Number average particle diameter of first external additive (nm) | Amount of first external additive (parts by mass) | Type of second external additive | Amount of second external additive (parts by mass) |
| Toner 1 | Toner particle 1 | 0.980 | Fine particle A-1 | 100 | 1.0 | Silica fine particle 1 | 0.8 |
| Toner 2 | Toner particle 2 | 0.972 | Fine particle A-1 | 100 | 1.0 | | 0.8 |
| Toner 3 | Toner particle 3 | 0.975 | Fine particle A-1 | 100 | 1.0 | | 0.8 |
| Toner 4 | Toner particle 4 | 0.976 | Fine particle A-1 | 100 | 1.0 | | 0.8 |
| Toner 5 | Toner particle 1 | 0.980 | Fine particle A-2 | 80 | 0.8 | | 0.8 |

TABLE 3-continued

| | Toner particle | | Formulation of external additive | | | | |
|---|---|---|---|---|---|---|---|
| | Type | Average circularity | Type of first external additive | Number average particle diameter of first external additive (nm) | Amount of first external additive (parts by mass) | Type of second external additive | Amount of second external additive (parts by mass) |
| Toner 6 | Toner particle 1 | 0.980 | Fine particle A-3 | 200 | 3.0 | | 0.8 |
| Toner 7 | Toner particle 1 | 0.980 | Fine particle A-4 | 400 | 5.0 | | 0.8 |
| Toner 8 | Toner particle 1 | 0.980 | Fine particle A-1 | 100 | 0.3 | | 0.8 |
| Toner 9 | Toner particle 1 | 0.980 | Fine particle A-1 | 100 | 0.5 | | 0.8 |
| Toner 10 | Toner particle 1 | 0.980 | Fine particle A-1 | 100 | 1.8 | | 0.8 |
| Toner 11 | Toner particle 1 | 0.980 | Fine particle A-1 | 100 | 3.0 | | 0.8 |
| Toner 12 | Toner particle 1 | 0.980 | Fine particle A-1 | 100 | 1.0 | | 0.8 |
| Toner 13 | Toner particle 1 | 0.980 | Fine particle A-1 | 100 | 1.0 | | 0.8 |
| Toner 14 | Toner particle 1 | 0.980 | Fine particle A-1 | 100 | 1.0 | | 0.8 |
| Toner 15 | Toner particle 1 | 0.980 | Fine particle A-1 | 100 | 1.0 | | 0.8 |
| Toner 16 | Toner particle 1 | 0.980 | Fine particle A-5 | 90 | 1.3 | | 0.8 |
| Toner 17 | Toner particle 1 | 0.980 | Fine particle A-6 | 110 | 1.3 | | 0.8 |
| Toner 18 | Toner particle 1 | 0.980 | Fine particle A-7 | 120 | 0.9 | | 0.8 |
| Toner 19 | Toner particle 1 | 0.980 | Fine particle A-8 | 96 | 0.7 | | 0.8 |
| Toner 20 | Toner particle 1 | 0.980 | Fine particle A-1 | 100 | 0.5 | | 0.8 |
| | | | Fine particle A-8 | 96 | 0.4 | | |
| Toner 21 | Toner particle 1 | 0.980 | Fine particle A-1 | 100 | 0.5 | Silica fine particle 2 | 0.8 |
| Toner 22 | Toner particle 1 | 0.980 | Fine particle A-9 | 60 | 0.6 | Silica fine particle 1 | 0.8 |
| Toner 23 | Toner particle 1 | 0.980 | Fine particle A-10 | 450 | 2.5 | | 0.8 |
| Toner 24 | Toner particle 1 | 0.980 | Fine particle A-1 | 100 | 0.05 | | 0.8 |
| Toner 25 | Toner particle 1 | 0.980 | Fine particle A-1 | 100 | 5.0 | | 0.8 |
| Toner 26 | Toner particle 1 | 0.980 | Fine particle A-1 | 100 | 1.0 | | 0.8 |
| Toner 27 | Toner particle 1 | 0.980 | Fine particle A-1 | 100 | 1.0 | | 0.8 |
| Toner 28 | Toner particle 1 | 0.980 | Fine particle A-1 | 100 | 1.0 | | 0.8 |

TABLE 4

| | Conditions on first external addition | | | Conditions on second external addition | | | Weight average particle diameter D4 (μm) | Coverage ratio with fine particle A (%) | Variation coefficient of fine particle A | Fixing rate of fine particle A (%) |
|---|---|---|---|---|---|---|---|---|---|---|
| | Apparatus | Circumferential velocity (m/s) | Time (sec) | Apparatus | Circumferential velocity (m/s) | Time (sec) | | | | |
| Toner 1 | Surface modification apparatus | 40 | 300 | Surface modification apparatus | 40 | 60 | 6.5 | 20 | 0.3 | 50 |
| Toner 2 | | 40 | 300 | | | | 6.7 | 18 | 0.4 | 48 |
| Toner 3 | | 40 | 300 | | | | 6.0 | 20 | 0.3 | 48 |
| Toner 4 | | 40 | 300 | | | | 6.5 | 18 | 0.4 | 50 |
| Toner 5 | | 40 | 300 | | | | 6.5 | 20 | 0.3 | 85 |
| Toner 6 | | 40 | 360 | | | | 6.5 | 18 | 0.4 | 42 |
| Toner 7 | | 40 | 600 | | | | 6.5 | 20 | 0.4 | 37 |
| Toner 8 | | 40 | 300 | | | | 6.5 | 5 | 0.3 | 55 |
| Toner 9 | | 40 | 300 | | | | 6.5 | 7 | 0.3 | 51 |
| Toner 10 | | 40 | 300 | | | | 6.5 | 30 | 0.3 | 50 |
| Toner 11 | | 40 | 300 | | | | 6.5 | 40 | 0.3 | 50 |
| Toner 12 | | 40 | 420 | | | | 6.5 | 20 | 0.3 | 81 |
| Toner 13 | | 40 | 240 | | | | 6.5 | 20 | 0.4 | 40 |
| Toner 14 | | 30 | 300 | | | | 6.5 | 20 | 0.5 | 30 |
| Toner 15 | Mechanofusion | 30 | 300 | | | | 6.5 | 20 | 0.5 | 50 |
| Toner 16 | Surface modification apparatus | 40 | 300 | | | | 6.5 | 18 | 0.3 | 53 |
| Toner 17 | | 40 | 300 | | | | 6.5 | 20 | 0.4 | 50 |
| Toner 18 | | 40 | 360 | | | | 6.5 | 20 | 0.3 | 51 |
| Toner 19 | | 40 | 300 | | | | 6.5 | 20 | 0.3 | 49 |
| Toner 20 | | 40 | 360 | | | | 6.5 | 22 | 0.3 | 52 |
| Toner 21 | | 40 | 300 | | | | 6.5 | 20 | 0.3 | 50 |
| Toner 22 | | 40 | 300 | | | | 6.5 | 20 | 0.4 | 50 |
| Toner 23 | | 40 | 300 | | | | 6.5 | 22 | 0.4 | 20 |
| Toner 24 | | 40 | 300 | | | | 6.5 | 3 | 0.4 | 60 |
| Toner 25 | | 40 | 420 | | | | 6.5 | 45 | 0.4 | 40 |
| Toner 26 | SUPERMIXER PICCOLO | 25 | 600 | SUPERMIXER PICCOLO | 25 | 60 | 6.5 | 20 | 0.5 | 20 |
| Toner 27 | Nobilta 130 | 25 | 300 | Nobilta 130 | 25 | 60 | 6.5 | 20 | 0.6 | 60 |
| Toner 28 | Henschel mixer FM10 | 40 | 300 | Henschel mixer FM10 | 40 | 60 | 6.5 | 20 | 0.6 | 34 |

<Evaluation Test>

Evaluation was performed with a modified machine of a laser beam printer LBP-9600 made by Canon Inc., in which the contact linear pressure of the cleaning blade was 80 N/m, the contact angle was 22°, and the process speed was 300 mm/sec. The photosensitive member had a diameter of 26 mm. A4-size normal paper was used in the evaluation. Under these conditions, the toner readily escapes from the cleaning blade due to low contact linear pressure of the cleaning blade.

<Transfer Efficiency>

Transfer efficiency was evaluated in a chart in which several images of a band (1 cm×20 cm) were formed. The transfer residues on the photosensitive member were removed with a tape, and the amount of the residual toner was observed. It was confirmed in all of the toners that the amount of the residual toner was small enough to attain high transfer performance.

<Evaluation of Cleaning Properties 1>

A durability test to continuously output 3000 sheets of a line image with a coverage rate of 5% was performed under an environment at low temperature and low humidity (10° C./14% Rh) to evaluate cleaning performance. Such an environment at low temperature and low humidity is severe to the cleaning operation because the cleaning blade is hardened to reduce the followability of the cleaning blade to the photosensitive member.

Evaluation was performed on the image density on the paper, which reflected the toner escaping from the cleaning blade. Specifically, the densities of white solid portions between lines were measured.

The image density was measured with a color reflection densitometer (X-RITE 404, made by X-Rite, Incorporated).

A: image density observed on the paper is less than 0.05

B: image density observed on the paper is 0.05 or more and less than 0.10

C: image density observed on the paper is 0.10 or more and less than 0.20

D: image density observed on the paper is 0.20 or more

<Evaluation of Cleaning Properties 2>

A durability test to intermittently output 10000 sheets of an image having a coverage rate of 5% while pausing every 50 sheets was performed under an environment at low temperature and low humidity (10° C./14% RH), and a halftone image was output to evaluate the contamination of the charging member. The amount of the toner applied onto the photosensitive member was 0.15 mg/cm$^2$ in output of the halftone image.

The image density was measured to numerically evaluate the contamination, which appears as white solid portions in the halftone image derived from contamination of the member.

The image density was measured with a color reflection densitometer (X-RITE 404, made by X-Rite, Incorporated).

A halftone image was output after the durability test. The image densities of halftone portions and those of white solid portions in the halftone image on the paper were measured, and the difference in image density was defined as the index for evaluation.

A: no image defects are found on the paper

B: the difference in image density is less than 0.1

C: the difference in image density is 0.1 or more and less than 0.2

D: the difference in image density is 0.2 or more

<Evaluation of Cleaning Properties 3>

After Evaluation of cleaning properties 1 was performed, the printer was left at 0° C./14% RH for 48 hours. Five sheets of a line image having a coverage rate of 5% were then output, and the image on the 6th sheet was used to evaluate escaping of the toner. This test was performed because the toner readily escapes from the cleaning blade immediately after the printer is left in environments at significantly low temperature.

Evaluation was performed on the image density on the paper, which reflected the toner escaping from the cleaning blade. Specifically, the densities of white solid portions between lines were measured.

The image density was measured with a color reflection densitometer (X-RITE 404, made by X-Rite, Incorporated).

A: toner density observed on the paper is less than 0.05

B: toner density observed on the paper is 0.05 or more and less than 0.10

C: toner density observed on the paper is 0.10 or more and less than 0.20

D: toner density observed on the paper is 0.20 or more

The results of evaluation are shown in Table 5.

TABLE 5

| | | Contact linear pressure of cleaning blade | Evaluation of cleaning properties 1 | | Evaluation of cleaning properties 2 | | Evaluation of cleaning properties 3 | |
|---|---|---|---|---|---|---|---|---|
| | Toner | (N/m) | Rank | Value | Rank | Value | Rank | Value |
| Example 1 | Toner 1 | 80 | A | 0.03 | B | 0.01 | A | 0.03 |
| Example 2 | Toner 2 | 80 | A | 0.03 | A | — | A | 0.03 |
| Example 3 | Toner 3 | 80 | A | 0.03 | A | — | A | 0.03 |
| Example 4 | Toner 4 | 80 | A | 0.03 | A | — | A | 0.03 |
| Example 5 | Toner 5 | 80 | A | 0.04 | B | 0.01 | B | 0.08 |
| Example 6 | Toner 6 | 80 | A | 0.03 | B | 0.01 | A | 0.03 |
| Example 7 | Toner 7 | 80 | A | 0.03 | C | 0.02 | A | 0.03 |
| Example 8 | Toner 8 | 80 | A | 0.03 | A | — | B | 0.07 |
| Example 9 | Toner 9 | 80 | A | 0.02 | A | — | A | 0.02 |
| Example 10 | Toner 10 | 80 | A | 0.03 | A | — | A | 0.03 |
| Example 11 | Toner 11 | 80 | A | 0.03 | B | 0.01 | A | 0.03 |
| Example 12 | Toner 12 | 80 | A | 0.01 | A | — | A | 0.01 |
| Example 13 | Toner 13 | 80 | A | 0.03 | B | 0.01 | A | 0.03 |
| Example 14 | Toner 14 | 80 | A | 0.03 | C | 0.03 | B | 0.09 |
| Example 15 | Toner 15 | 80 | B | 0.06 | B | 0.01 | B | 0.07 |
| Example 16 | Toner 16 | 80 | A | 0.03 | A | — | A | 0.03 |
| Example 17 | Toner 17 | 80 | A | 0.03 | A | — | A | 0.03 |
| Example 18 | Toner 18 | 80 | A | 0.01 | B | 0.01 | A | 0.01 |
| Example 19 | Toner 19 | 80 | A | 0.01 | A | — | A | 0.01 |

TABLE 5-continued

| | Toner | Contact linear pressure of cleaning blade (N/m) | Evaluation of cleaning properties 1 Rank | Evaluation of cleaning properties 1 Value | Evaluation of cleaning properties 2 Rank | Evaluation of cleaning properties 2 Value | Evaluation of cleaning properties 3 Rank | Evaluation of cleaning properties 3 Value |
|---|---|---|---|---|---|---|---|---|
| Example 20 | Toner 20 | 80 | A | 0.02 | A | — | A | 0.02 |
| Example 21 | Toner 21 | 80 | A | 0.03 | A | — | B | 0.07 |
| Example 22 | Toner 1 | 120 | B | 0.09 | B | 0.01 | C | 0.08 |
| Comparative Example 1 | Toner 22 | 80 | C | 0.11 | C | 0.04 | C | 0.11 |
| Comparative Example 2 | Toner 23 | 80 | C | 0.18 | D | 0.06 | C | 0.18 |
| Comparative Example 3 | Toner 24 | 80 | C | 0.15 | C | 0.03 | D | 0.25 |
| Comparative Example 4 | Toner 25 | 80 | C | 0.12 | C | 0.04 | D | 0.22 |
| Comparative Example 5 | Toner 26 | 80 | C | 0.15 | D | 0.07 | C | 0.15 |
| Comparative Example 6 | Toner 27 | 80 | C | 0.16 | C | 0.04 | C | 0.16 |
| Comparative Example 7 | Toner 28 | 81 | C | 0.16 | C | 0.04 | C | 0.16 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-161482, filed Aug. 7, 2014, which is hereby incorporated by reference herein in its entirety.

What is claimed is:

1. A toner comprising a toner particle containing a binder resin and a colorant, and a fine particle A, wherein the toner has an average circularity of 0.970 or more, a number average particle diameter (D1) of a primary particle of the fine particle A is 80 to 400 nm, a coverage ratio of the surface of the toner particle covered with the fine particle A is 5 to 40% as determined by electron spectroscopy for chemical analysis (ESCA), a variation coefficient of the number of the fine particle A present in a region of 0.5 $\pi\mu m^2$ on the surface of the toner particle is 0.1 to 0.5, and a fixing rate of the fine particle A after washing the toner with water is 30 to 90% by mass.

2. The toner according to claim 1, wherein the fine particle A is selected from the group consisting of a silica fine particle, a titanium oxide fine particle, an alumina fine particle, and an organic-inorganic composite fine particle.

3. The toner according to claim 1, wherein the fine particle A is an organic-inorganic composite fine particle, the organic-inorganic composite fine particle (1) comprising a vinyl resin particle, and an inorganic fine particle B embedded in the vinyl resin particle, (2) having the inorganic fine particle B in the state of being exposed on the surface of the organic-inorganic composite fine particle, providing a convex portion derived from the inorganic fine particle B, and (3) having a coverage ratio of the surface of the vinyl resin particle covered with the inorganic fine particle B of 20 to 70% as determined by ESCA.

4. The toner according to claim 1, wherein the toner has an average circularity of 0.975 or more.

5. The toner according to claim 1, wherein the coverage ratio of the surface of the toner particle covered with the fine particle A is 5 to 30%.

6. The toner according to claim 1, wherein the variation coefficient is 0.1 to 0.4.

7. The toner according to claim 1, wherein the number average particle diameter (D1) of the primary particle of the fine particle A is 90 to 200 nm.

8. The toner according to claim 3, wherein the organic-inorganic composite fine particle has a shape factor SF-1 of 100 to 150.

9. The toner according to claim 3, wherein the organic-inorganic composite fine particle has a shape factor SF-1 of 100 to 120.

10. The toner according to claim 3, wherein the organic-inorganic composite fine particle has a shape factor SF-2 of 100 to 150.

11. The toner according to claim 3, wherein the organic-inorganic composite fine particle has a shape factor SF-2 of 110 to 150.

12. An imaging method, comprising:

charging a photosensitive member;

forming an electrostatic latent image on the photosensitive member;

developing the electrostatic latent image with a toner into a toner image;

transferring the toner image onto a transfer medium; and removing a residual toner on the surface of the photosensitive member with a cleaning blade after the transfer of the toner image, the photosensitive member having a diameter of 20 to 50 mm, and a contact pressure of the cleaning blade pressed against the photosensitive member of 30 to 105 N/m, expressed in terms of a linear pressure per unit length in a longitudinal direction of a contact region, wherein the toner comprises a toner particle containing a binder resin and a colorant, and a fine particle A, the toner has an average circularity of 0.970 or more, a number average particle diameter (D1) of a primary particle of the fine particle A is 80 to 400 nm, a coverage ratio of the surface of the toner particle covered with the fine particle A is 5 to 40% as determined by electron spectroscopy for chemical analysis (ESCA), a fixing rate of the fine particle A after washing the toner with water is 30 to 90% by mass, and a variation coefficient of the number of the fine particle A present in a region of 0.5 $\pi\mu m^2$ on the surface of the toner particle is 0.1 to 0.5.

13. A process for producing a toner comprising a toner particle containing a binder resin and a colorant, and a fine particle A, the toner having an average circularity of 0.970 or more, the fine particle A containing a primary particle having a number average particle diameter (D1) of 80 to 400 nm, a coverage ratio of the surface of the toner particle covered with the fine particle A being 5 to 40% as determined by electron spectroscopy for chemical analysis (ESCA), the toner containing the fine particle A at a fixing rate of 30 to 90% by mass after washing the toner with water, and a variation coefficient of the number of the fine particle A present in a region of 0.5 $\pi\mu m^2$ on the surface of the toner particle being 0.1 to 0.5, the process includes a treatment step for mixing with using a treatment apparatus having a treatment chamber accommodating objects including the toner particle and the fine particle A; and a rotator disposed in the treatment chamber to be rotatable about a driving axis, the rotator including (i) a rotary body and (ii) a treating unit having a treatment surface treating the objects through collision between the treatment surface and the objects caused by rotation of the rotator, wherein the treatment surface extending from the outer peripheral surface of the rotary body toward the outside in the diameter direction, the outer region of the treatment surface is arranged at downstream position in the rotational direction with respect to the inner region of the treatment surface.

* * * * *